US010864431B2

(12) United States Patent
Stasson et al.

(10) Patent No.: US 10,864,431 B2
(45) **Date of Patent: *Dec. 15, 2020**

(54) METHODS OF MAKING AND USING HAND-FORMING CARD SHUFFLERS

(71) Applicant: SG Gaming, Inc., Las Vegas, NV (US)

(72) Inventors: James B. Stasson, Chaska, MN (US); Robert J. Rynda, Las Vegas, NV (US); James P. Helgesen, Eden Prairie, MN (US); Troy D. Nelson, Big Lake, MN (US); Paul K. Scheper, Bloomington, MN (US); Ronald R. Swanson, Otsego, MN (US); Colin A. Helsen, Arundel (AU); Nathan J. Wadds, Waverley (AU)

(73) Assignee: SG Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/256,919

(22) Filed: Jan. 24, 2019

(65) Prior Publication Data

US 2019/0151746 A1 May 23, 2019

Related U.S. Application Data

(63) Continuation of application No. 15/377,573, filed on Dec. 13, 2016, now Pat. No. 10,238,954, which is a (Continued)

(51) Int. Cl.
*A63F 1/12* (2006.01)

(52) U.S. Cl.
CPC ..... *A63F 1/12* (2013.01); *A63F 2300/00* (2013.01)

(58) Field of Classification Search
CPC ..... A63F 1/12; A63F 1/14

(Continued)

(56) References Cited

U.S. PATENT DOCUMENTS 130,281 A 8/1872 Coughlin
205,030 A 6/1878 Ash (Continued)

FOREIGN PATENT DOCUMENTS

AU 2383667 A 1/1969
AU 5025479 A1 3/1980

(Continued)

OTHER PUBLICATIONS

Canadian Office Action for CA 2,580,309 dated Mar. 20, 2012 (6 pages).

(Continued)

*Primary Examiner* — John E Simms, Jr.
*Assistant Examiner* — Dolores R Collins
(74) *Attorney, Agent, or Firm* — TraskBritt

(57) ABSTRACT

Methods of using automatic card shufflers may involve causing playing cards to be moved from a card input area to a temporary card storage utilizing a card input mechanism. A first number of playing card hands may be formed in a corresponding first number of designated card storage compartments of the temporary card storage when a control system of the automatic card shuffler is in a first operational mode. A second, different number of playing card hands may be formed in a corresponding second number of designated card storage compartments of the temporary card storage when the control system is in a second operational mode. The card storage compartments of the second number of designated card storage compartments may be distinct from the card storage compartments of the first number of designated card storage compartments.

20 Claims, 14 Drawing Sheets

Related U.S. Application Data continuation of application No. 14/450,008, filed on Aug. 1, 2014, now Pat. No. 9,566,501.

(58) Field of Classification Search
USPC ..... 273/149 R
See application file for complete search history.

(56) References Cited

U.S. PATENT DOCUMENTS 609,730 A 8/1898 Booth
673,154 A 4/1901 Bellows
793,489 A 6/1905 Williams
892,389 A 7/1908 Bellows
1,014,219 A 1/1912 Hall
1,043,109 A 11/1912 Hurm
1,157,898 A 10/1915 Perret
1,256,509 A 2/1918 Belknap
1,380,898 A 6/1921 Hall
1,556,856 A 10/1925 Lipps
1,757,553 A 5/1930 Tauschek
1,850,114 A 3/1932 McCaddin
1,885,276 A 11/1932 McKay
1,889,729 A 11/1932 Hammond
1,955,926 A 4/1934 Matthaey
1,992,085 A 2/1935 McKay
1,998,690 A 4/1935 Shepherd et al.
2,001,220 A 5/1935 Smith
2,001,918 A 5/1935 Nevius
2,016,030 A 10/1935 Woodruff et al.
2,043,343 A 6/1936 Warner
2,060,096 A 11/1936 McCoy
2,065,824 A 12/1936 Plass
2,159,958 A 5/1939 Sachs
2,185,474 A 1/1940 Nott
2,254,484 A 9/1941 Hutchins
D132,360 S 5/1942 Gardner
2,282,040 A * 5/1942 Doran ..... H01F 38/12 361/269
2,328,153 A 8/1943 Laing
2,328,879 A 9/1943 Isaacson
D139,530 S 11/1944 Schindler
2,364,413 A 12/1944 Wittel
2,525,305 A 10/1950 Lombard
2,543,522 A 2/1951 Cohen
2,588,582 A 3/1952 Sivertson
2,615,719 A 10/1952 Fonken
2,659,607 A 11/1953 Skillman et al.
2,661,215 A 12/1953 Stevens
2,676,020 A 4/1954 Ogden
2,692,777 A 10/1954 Miller
2,701,720 A 2/1955 Ogden
2,705,638 A 4/1955 Newcomb
2,711,319 A 6/1955 Morgan et al.
2,714,510 A 8/1955 Oppenlander et al.
2,717,782 A 9/1955 Droll
2,727,747 A 12/1955 Semisch, Jr.
2,731,271 A 1/1956 Brown
2,747,877 A 5/1956 Howard
2,755,090 A 7/1956 Aldrich
2,757,005 A 7/1956 Nothaft
2,760,779 A 8/1956 Ogden et al.
2,770,459 A 11/1956 Wilson et al.
2,778,643 A 1/1957 Williams
2,778,644 A 1/1957 Stephenson
2,782,040 A 2/1957 Matter
2,790,641 A 4/1957 Adams
2,793,863 A 5/1957 Liebelt
2,815,214 A 12/1957 Hall
2,821,399 A 1/1958 Heinoo
2,914,215 A 11/1959 Neidig
2,937,739 A 5/1960 Levy
2,950,005 A 8/1960 MacDonald
RE24,986 E 5/1961 Stephenson
3,067,885 A 12/1962 Kohler
3,107,096 A 10/1963 Osborn
3,124,674 A 3/1964 Edwards et al.
3,131,935 A 5/1964 Gronneberg
3,147,978 A 9/1964 Sjostrand
D200,652 S 3/1965 Fisk
3,185,482 A 5/1965 Russell
3,222,071 A 12/1965 Lang
3,235,741 A 2/1966 Plaisance
3,288,308 A 11/1966 Gingher
3,305,237 A 2/1967 Granius
3,312,473 A 4/1967 Friedman et al.
3,452,509 A 7/1969 Hauer
3,530,968 A 9/1970 Palmer
3,588,116 A 6/1971 Miura
3,589,730 A 6/1971 Slay
3,595,388 A 7/1971 Castaldi
3,597,076 A 8/1971 Hubbard et al.
3,598,396 A 8/1971 Andrews et al.
3,618,933 A 11/1971 Roggenstein et al.
3,627,331 A 12/1971 Lyon, Jr.
3,666,270 A 5/1972 Mazur
3,680,853 A 8/1972 Houghton et al.
3,690,670 A 9/1972 Cassady et al.
3,704,938 A 12/1972 Fanselow
3,716,238 A 2/1973 Porter
3,751,041 A 8/1973 Seifert
3,761,079 A 9/1973 Azure, Jr.
3,810,627 A 5/1974 Levy
D232,953 S 9/1974 Oguchi
3,861,261 A 1/1975 Maxey
3,897,954 A 8/1975 Erickson et al.
3,899,178 A 8/1975 Watanabe
3,909,002 A 9/1975 Levy
3,929,339 A 12/1975 Mattioli
3,944,077 A 3/1976 Green
3,944,230 A 3/1976 Fineman
3,949,219 A 4/1976 Crouse
3,968,364 A 7/1976 Miller
3,981,163 A * 9/1976 Tillotson ..... D06B 1/147 68/5 D
4,023,705 A 5/1977 Reiner et al.
4,033,590 A 7/1977 Pic
4,072,930 A 2/1978 Lucero et al.
4,088,265 A 5/1978 Garczynski
4,151,410 A 4/1979 McMillan et al.
4,159,581 A 7/1979 Lichtenberg
4,162,649 A 7/1979 Thornton
4,166,615 A 9/1979 Noguchi et al.
4,232,861 A 11/1980 Maul
4,280,690 A 7/1981 Hill
4,283,709 A 8/1981 Lucero et al.
4,310,160 A 1/1982 Willette et al.
4,339,134 A 7/1982 Macheel
4,339,798 A 7/1982 Hedges et al.
4,361,393 A 11/1982 Noto
4,368,972 A 1/1983 Naramore
4,369,972 A 1/1983 Parker
4,374,309 A 2/1983 Walton
4,377,285 A 3/1983 Kadlic
4,385,827 A 5/1983 Naramore
4,388,994 A 6/1983 Suda et al.
4,397,469 A 8/1983 Carter, III
4,421,312 A 12/1983 Delgado et al.
4,421,501 A 12/1983 Scheller
D273,962 S 5/1984 Fromm
D274,069 S 5/1984 Fromm
4,457,512 A 7/1984 Stevenson
4,467,424 A 8/1984 Hedges et al.
4,494,197 A 1/1985 Troy et al.
4,497,488 A 2/1985 Plevyak et al.
4,512,580 A 4/1985 Matviak
4,513,969 A 4/1985 Samsel, Jr.
4,515,367 A 5/1985 Howard
4,531,187 A 7/1985 Uhland
4,534,562 A 8/1985 Cuff et al.
4,549,738 A 10/1985 Greitzer
4,566,782 A 1/1986 Britt et al.
4,575,367 A 3/1986 Karmel
4,586,712 A 5/1986 Lorber et al.
4,659,082 A 4/1987 Greenberg

(56) References Cited

U.S. PATENT DOCUMENTS 4,662,637 A 5/1987 Pfeiffer
4,662,816 A 5/1987 Fabrig
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,412 A 9/1988 Wolfe
4,770,421 A 9/1988 Hoffman
4,807,884 A 2/1989 Breeding
4,822,050 A 4/1989 Normand et al.
4,832,342 A 5/1989 Plevyak et al.
4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 LeVasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 LeStrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Gamer
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.

(56) References Cited

U.S. PATENT DOCUMENTS

| | | | |
|---|---|---|---|
| 6,093,103 | A | 7/2000 | McCrea, Jr. |
| 6,113,101 | A | 9/2000 | Wirth |
| 6,117,012 | A | 9/2000 | McCrea, Jr. |
| D432,588 | S | 10/2000 | Tedham |
| 6,126,166 | A | 10/2000 | Lorson et al. |
| 6,131,817 | A | 10/2000 | Miller |
| 6,139,014 | A | 10/2000 | Breeding et al. |
| 6,149,154 | A | 11/2000 | Grauzer et al. |
| 6,154,131 | A | 11/2000 | Jones, II et al. |
| 6,165,069 | A | 12/2000 | Sines et al. |
| 6,165,072 | A | 12/2000 | Davis et al. |
| 6,183,362 | B1 | 2/2001 | Boushy |
| 6,186,895 | B1 | 2/2001 | Oliver |
| 6,196,416 | B1 | 3/2001 | Seagle |
| 6,200,218 | B1 | 3/2001 | Lindsay |
| 6,210,274 | B1 | 4/2001 | Carlson |
| 6,213,310 | B1 | 4/2001 | Wennersten et al. |
| 6,217,447 | B1 | 4/2001 | Lofink et al. |
| 6,234,900 | B1 | 5/2001 | Cumbers |
| 6,236,223 | B1 | 5/2001 | Brady et al. |
| 6,250,632 | B1 | 6/2001 | Albrecht |
| 6,254,002 | B1 | 7/2001 | Litman |
| 6,254,096 | B1 | 7/2001 | Grauzer et al. |
| 6,254,484 | B1 | 7/2001 | McCrea, Jr. |
| 6,257,981 | B1 | 7/2001 | Acres et al. |
| 6,267,248 | B1 | 7/2001 | Johnson et al. |
| 6,267,648 | B1 | 7/2001 | Katayama et al. |
| 6,267,671 | B1 | 7/2001 | Hogan |
| 6,270,404 | B2 | 8/2001 | Sines et al. |
| 6,272,223 | B1 | 8/2001 | Carlson |
| 6,293,546 | B1 | 9/2001 | Hessing et al. |
| 6,293,864 | B1 | 9/2001 | Romero |
| 6,299,167 | B1 | 10/2001 | Sines et al. |
| 6,299,534 | B1 | 10/2001 | Breeding et al. |
| 6,299,536 | B1 | 10/2001 | Hill |
| 6,308,886 | B1 | 10/2001 | Benson et al. |
| 6,313,871 | B1 | 11/2001 | Schubert |
| 6,325,373 | B1 | 12/2001 | Breeding et al. |
| 6,334,614 | B1 | 1/2002 | Breeding |
| 6,341,778 | B1 | 1/2002 | Lee |
| 6,342,830 | B1 | 1/2002 | Want et al. |
| 6,346,044 | B1 | 2/2002 | McCrea, Jr. |
| 6,361,044 | B1 | 3/2002 | Block |
| 6,386,973 | B1 | 5/2002 | Yoseloff |
| 6,402,142 | B1 | 6/2002 | Warren et al. |
| 6,403,908 | B2 | 6/2002 | Stardust et al. |
| 6,443,839 | B2 | 9/2002 | Stockdale et al. |
| 6,446,864 | B1 | 9/2002 | Kim et al. |
| 6,454,266 | B1 | 9/2002 | Breeding et al. |
| 6,460,848 | B1 | 10/2002 | Soltys et al. |
| 6,464,584 | B2 | 10/2002 | Oliver |
| 6,490,277 | B1 | 12/2002 | Tzotzkov |
| 6,508,709 | B1 | 1/2003 | Karmarkar |
| 6,514,140 | B1 | 2/2003 | Storch |
| 6,517,435 | B2 | 2/2003 | Soltys et al. |
| 6,517,436 | B2 | 2/2003 | Soltys et al. |
| 6,520,857 | B2 | 2/2003 | Soltys et al. |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,532,297 | B1 | 3/2003 | Lindquist |
| 6,533,276 | B2 | 3/2003 | Soltys et al. |
| 6,533,662 | B2 | 3/2003 | Soltys et al. |
| 6,543,770 | B1 | 4/2003 | Kaji et al. |
| 6,561,897 | B1 | 5/2003 | Bourbour et al. |
| 6,568,678 | B2 | 5/2003 | Breeding et al. |
| 6,579,180 | B2 | 6/2003 | Soltys et al. |
| 6,579,181 | B2 | 6/2003 | Soltys et al. |
| 6,581,747 | B1 | 6/2003 | Charlier et al. |
| 6,582,301 | B2 | 6/2003 | Hill |
| 6,582,302 | B2 | 6/2003 | Romero |
| 6,585,586 | B1 | 7/2003 | Romero |
| 6,585,588 | B2 | 7/2003 | Hard |
| 6,585,856 | B2 | 7/2003 | Zwick et al. |
| 6,588,750 | B1 | 7/2003 | Grauzer et al. |
| 6,588,751 | B1 | 7/2003 | Grauzer et al. |
| 6,595,857 | B2 | 7/2003 | Soltys et al. |
| 6,609,710 | B1 | 8/2003 | Order |
| 6,612,928 | B1 | 9/2003 | Bradford et al. |
| 6,616,535 | B1 | 9/2003 | Nishizaki et al. |
| 6,619,662 | B2 | 9/2003 | Miller |
| 6,622,185 | B1 | 9/2003 | Johnson et al. |
| 6,626,757 | B2 | 9/2003 | Oliveras |
| 6,629,019 | B2 | 9/2003 | Legge et al. |
| 6,629,591 | B1 | 10/2003 | Griswold et al. |
| 6,629,889 | B2 | 10/2003 | Mothwurf |
| 6,629,894 | B1 | 10/2003 | Purton |
| 6,637,622 | B1 | 10/2003 | Robinson |
| 6,638,161 | B2 | 10/2003 | Soltys et al. |
| 6,645,068 | B1 | 11/2003 | Kelly et al. |
| 6,645,077 | B2 | 11/2003 | Rowe |
| 6,651,981 | B2 | 11/2003 | Grauzer et al. |
| 6,651,982 | B2 | 11/2003 | Grauzer et al. |
| 6,651,985 | B2 | 11/2003 | Sines et al. |
| 6,652,379 | B2 | 11/2003 | Soltys et al. |
| 6,655,684 | B2 | 12/2003 | Grauzer et al. |
| 6,655,690 | B1 | 12/2003 | Oskwarek |
| 6,658,135 | B1 | 12/2003 | Morito et al. |
| 6,659,460 | B2 | 12/2003 | Blaha et al. |
| 6,659,461 | B2 | 12/2003 | Yoseloff |
| 6,659,875 | B2 | 12/2003 | Purton |
| 6,663,490 | B2 | 12/2003 | Soltys et al. |
| 6,666,768 | B1 | 12/2003 | Akers |
| 6,671,358 | B1 | 12/2003 | Seidman et al. |
| 6,676,127 | B2 | 1/2004 | Johnson et al. |
| 6,676,517 | B2 | 1/2004 | Beavers |
| 6,680,843 | B2 | 1/2004 | Farrow et al. |
| 6,685,564 | B2 | 2/2004 | Oliver |
| 6,685,567 | B2 | 2/2004 | Cockerille et al. |
| 6,685,568 | B2 | 2/2004 | Soltys et al. |
| 6,688,597 | B2 | 2/2004 | Jones |
| 6,688,979 | B2 | 2/2004 | Soltys et al. |
| 6,690,673 | B1 | 2/2004 | Jarvis |
| 6,698,756 | B1 | 3/2004 | Baker et al. |
| 6,698,759 | B2 | 3/2004 | Webb et al. |
| 6,702,289 | B1 | 3/2004 | Feola |
| 6,702,290 | B2 | 3/2004 | Buono-Correa et al. |
| 6,709,333 | B1 | 3/2004 | Bradford et al. |
| 6,712,696 | B2 | 3/2004 | Soltys et al. |
| 6,719,288 | B2 | 4/2004 | Hessing et al. |
| 6,719,634 | B2 | 4/2004 | Mishina et al. |
| 6,722,974 | B2 | 4/2004 | Sines et al. |
| 6,726,205 | B1 | 4/2004 | Purton |
| 6,732,067 | B1 | 5/2004 | Powderly |
| 6,733,012 | B2 | 5/2004 | Bui et al. |
| 6,733,388 | B2 | 5/2004 | Mothwurf |
| 6,746,333 | B1 | 6/2004 | Onda et al. |
| 6,747,560 | B2 | 6/2004 | Stevens, III |
| 6,749,510 | B2 | 6/2004 | Giobbi |
| 6,758,751 | B2 | 7/2004 | Soltys et al. |
| 6,758,757 | B2 | 7/2004 | Luciano, Jr. et al. |
| 6,769,693 | B2 | 8/2004 | Huard et al. |
| 6,774,782 | B2 | 8/2004 | Runyon et al. |
| 6,789,801 | B2 | 9/2004 | Snow |
| 6,802,510 | B1 | 10/2004 | Haber |
| 6,804,763 | B1 | 10/2004 | Stockdale et al. |
| 6,808,173 | B2 | 10/2004 | Snow |
| 6,827,282 | B2 | 12/2004 | Silverbrook |
| 6,834,251 | B1 | 12/2004 | Fletcher |
| 6,840,517 | B2 | 1/2005 | Snow et al. |
| 6,842,263 | B1 | 1/2005 | Saeki |
| 6,843,725 | B2 | 1/2005 | Nelson |
| 6,848,616 | B2 | 2/2005 | Tsirline et al. |
| 6,848,844 | B2 | 2/2005 | McCue, Jr. et al. |
| 6,848,994 | B1 | 2/2005 | Knust et al. |
| 6,857,961 | B2 | 2/2005 | Soltys et al. |
| 6,874,784 | B1 | 4/2005 | Promutico et al. |
| 6,874,786 | B2 | 4/2005 | Bruno |
| 6,877,657 | B2 | 4/2005 | Ranard et al. |
| 6,877,748 | B1 | 4/2005 | Patroni et al. |
| 6,886,829 | B2 | 5/2005 | Hessing et al. |
| 6,889,979 | B2 | 5/2005 | Blaha et al. |
| 6,893,347 | B1 | 5/2005 | Zilliacus et al. |
| 6,899,628 | B2 | 5/2005 | Leen et al. |

(56) References Cited

U.S. PATENT DOCUMENTS 6,902,167 B2 6/2005 Webb
6,905,121 B1 6/2005 Timpano
6,923,446 B2 8/2005 Snow
6,938,900 B2 9/2005 Snow
6,941,180 B1 9/2005 Fisher et al.
6,950,948 B2 9/2005 Neff
6,955,599 B2 10/2005 Bourbour et al.
6,957,746 B2 10/2005 Martin et al.
6,959,925 B1 11/2005 Baker et al.
6,960,134 B2 11/2005 Hartl et al.
6,964,612 B2 11/2005 Soltys et al.
6,986,514 B2 1/2006 Snow
6,988,516 B2 1/2006 Debaes
7,011,309 B2 3/2006 Soltys et al.
7,020,307 B2 3/2006 Hinton et al.
7,028,598 B2 4/2006 Teshima
7,029,009 B2 4/2006 Grauzer et al.
7,036,818 B2 5/2006 Grauzer et al.
7,046,458 B2 5/2006 Nakayama
7,046,764 B1 5/2006 Kump
7,048,629 B2 5/2006 Sines et al.
7,059,602 B2 * 6/2006 Grauzer ..... A63F 1/12 273/149 P
7,066,464 B2 6/2006 Blad et al.
7,068,822 B2 6/2006 Scott
7,073,791 B2 * 7/2006 Grauzer ..... A63F 1/12 273/149 P
7,079,010 B2 7/2006 Champlin
7,084,769 B2 8/2006 Bauer et al.
7,089,420 B1 8/2006 Durst et al.
D527,900 S 9/2006 Dewa
7,106,201 B2 9/2006 Tuttle
7,113,094 B2 9/2006 Garber et al.
7,114,718 B2 10/2006 Grauzer et al.
7,124,947 B2 10/2006 Storch
7,128,652 B1 10/2006 Lavoie et al.
7,137,627 B2 11/2006 Grauzer et al.
7,139,108 B2 11/2006 Andersen et al.
7,140,614 B2 11/2006 Snow
7,162,035 B1 1/2007 Durst et al.
7,165,769 B2 1/2007 Crenshaw et al.
7,165,770 B2 1/2007 Snow
7,175,522 B2 2/2007 Hartl
7,186,181 B2 3/2007 Rowe
7,201,656 B2 4/2007 Darder
7,202,888 B2 4/2007 Tecu et al.
7,203,841 B2 4/2007 Jackson et al.
7,213,812 B2 5/2007 Schubert
7,222,852 B2 5/2007 Soltys
7,222,855 B2 5/2007 Sorge
7,231,812 B1 6/2007 Lagare
7,234,698 B2 6/2007 Grauzer et al.
7,237,969 B2 7/2007 Bartman
7,243,148 B2 7/2007 Keir et al.
7,243,698 B2 7/2007 Siegel
7,246,799 B2 7/2007 Snow
7,255,344 B2 8/2007 Grauzer et al.
7,255,351 B2 8/2007 Yoseloff et al.
7,255,642 B2 8/2007 Sines et al.
7,257,630 B2 8/2007 Cole et al.
7,261,294 B2 8/2007 Grauzer et al.
7,264,241 B2 9/2007 Schubert et al.
7,264,243 B2 9/2007 Yoseloff et al.
7,277,570 B2 10/2007 Armstrong
7,278,923 B2 10/2007 Grauzer et al.
7,294,056 B2 11/2007 Lowell et al.
7,297,062 B2 11/2007 Gatto et al.
7,300,056 B2 11/2007 Gioia et al.
7,303,473 B2 12/2007 Rowe
7,303,475 B2 12/2007 Britt et al.
7,309,065 B2 12/2007 Yoseloff et al.
7,316,609 B2 1/2008 Dunn et al.
7,316,615 B2 1/2008 Soltys et al.
7,322,576 B2 1/2008 Grauzer et al.
7,331,579 B2 2/2008 Snow
7,334,794 B2 2/2008 Snow
7,338,044 B2 * 3/2008 Grauzer ..... A63F 1/12 273/149 R
7,338,362 B1 3/2008 Gallagher
7,341,510 B2 3/2008 Bourbour et al.
D566,784 S 4/2008 Palmer
7,357,321 B2 4/2008 Yoshida
7,360,094 B2 4/2008 Neff
7,367,561 B2 5/2008 Blaha et al.
7,367,563 B2 5/2008 Yoseloff et al.
7,367,565 B2 * 5/2008 Chiu ..... A63B 26/003 273/109
7,367,884 B2 5/2008 Breeding et al.
7,374,170 B2 5/2008 Grauzer et al.
7,384,044 B2 6/2008 Grauzer et al.
7,387,300 B2 6/2008 Snow
7,389,990 B2 6/2008 Mourad
7,390,256 B2 6/2008 Soltys et al.
7,399,226 B2 7/2008 Mishra
7,407,438 B2 8/2008 Schubert et al.
7,413,191 B2 8/2008 Grauzer et al.
7,434,805 B2 10/2008 Grauzer et al.
7,436,957 B1 10/2008 Fisher et al.
7,448,626 B2 11/2008 Fleckenstein
7,458,582 B2 12/2008 Snow et al.
7,461,843 B1 12/2008 Baker et al.
7,464,932 B2 12/2008 Darling
7,464,934 B2 12/2008 Schwartz
7,472,906 B2 1/2009 Shai
7,478,813 B1 1/2009 Hofferber et al.
7,500,672 B2 3/2009 Ho
7,506,874 B2 3/2009 Hall
7,510,186 B2 3/2009 Fleckenstein
7,510,190 B2 3/2009 Snow et al.
7,510,194 B2 3/2009 Soltys et al.
7,510,478 B2 3/2009 Benbrahim et al.
7,513,437 B2 4/2009 Douglas
7,515,718 B2 4/2009 Nguyen et al.
7,523,935 B2 4/2009 Grauzer et al.
7,523,936 B2 4/2009 Grauzer et al.
7,523,937 B2 4/2009 Fleckenstein
7,525,510 B2 4/2009 Beland et al.
7,537,216 B2 5/2009 Soltys et al.
7,540,497 B2 6/2009 Tseng
7,540,498 B2 6/2009 Crenshaw et al.
7,549,643 B2 6/2009 Quach
7,554,753 B2 6/2009 Wakamiya
7,556,197 B2 7/2009 Yoshida
7,556,266 B2 7/2009 Blaha et al.
7,575,237 B2 8/2009 Snow
7,578,506 B2 8/2009 Lambert
7,584,962 B2 9/2009 Breeding et al.
7,584,963 B2 9/2009 Krenn et al.
7,584,966 B2 9/2009 Snow
7,591,728 B2 9/2009 Gioia et al.
7,593,544 B2 9/2009 Downs
7,594,660 B2 9/2009 Baker et al.
7,597,623 B2 10/2009 Grauzer et al.
7,644,923 B1 1/2010 Dickinson et al.
7,661,676 B2 * 2/2010 Smith ..... A63F 1/00 273/149 R
7,666,090 B2 2/2010 Hettinger
7,669,852 B2 3/2010 Baker et al.
7,669,853 B2 3/2010 Jones
7,677,565 B2 3/2010 Grauzer et al.
7,677,566 B2 3/2010 Krenn et al.
7,686,681 B2 3/2010 Soltys et al.
7,699,694 B2 4/2010 Hill
7,735,657 B2 6/2010 Johnson
7,740,244 B2 6/2010 Ho
7,744,452 B2 6/2010 Cimring et al.
7,753,373 B2 * 7/2010 Grauzer ..... A63F 1/18 273/149 R
7,753,374 B2 7/2010 Ho
7,753,798 B2 7/2010 Soltys
7,758,425 B2 7/2010 Poh et al.
7,762,554 B2 7/2010 Ho
7,764,836 B2 7/2010 Downs et al.
7,766,332 B2 8/2010 Grauzer et al.

(56) References Cited

U.S. PATENT DOCUMENTS 7,766,333 B1 8/2010 Stardust
7,769,232 B2 8/2010 Downs, III
7,769,853 B2 8/2010 Nezamzadeh
7,773,749 B1 8/2010 Durst et al.
7,780,529 B2 8/2010 Rowe et al.
7,784,790 B2 8/2010 Grauzer et al.
7,804,982 B2 9/2010 Howard et al.
7,824,255 B2 11/2010 Lutnick
7,846,020 B2 12/2010 Walker et al.
7,854,430 B2 12/2010 Toyama
7,867,080 B2 1/2011 Nicely et al.
7,890,365 B2 2/2011 Hettinger
7,900,923 B2 3/2011 Toyama et al.
7,901,285 B2 3/2011 Tran et al.
7,908,169 B2 3/2011 Hettinger
7,909,689 B2 3/2011 Lardie
7,931,533 B2 4/2011 LeMay et al.
7,933,448 B2 4/2011 Downs, III
7,946,586 B2 5/2011 Krenn et al.
7,967,294 B2 6/2011 Blaha et al.
7,976,023 B1 7/2011 Hessing et al.
7,988,152 B2 8/2011 Sines et al.
7,988,554 B2 8/2011 LeMay et al.
7,995,196 B1 8/2011 Fraser
8,002,638 B2 8/2011 Grauzer et al.
8,011,661 B2 * 9/2011 Stasson ..... A63F 1/12 273/149 R
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 * 1/2013 Scheper ..... A63F 1/12 273/149 R
8,342,526 B1 1/2013 Sampson
8,342,529 B2 1/2013 Snow
8,353,513 B2 1/2013 Swanson
8,381,918 B2 2/2013 Johnson
8,419,521 B2 4/2013 Grauzer et al.
8,429,229 B2 4/2013 Sepich et al.
8,444,147 B2 * 5/2013 Grauzer ..... A63F 1/18 273/149 R
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,548,327 B2 * 10/2013 Hirth ..... H04Q 11/0067 398/67
8,550,464 B2 10/2013 Soltys et al.
8,556,263 B2 10/2013 Grauzer et al.
8,579,289 B2 11/2013 Rynda et al.
RE44,616 E 12/2013 Blaha et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 * 4/2014 Scheper ..... A63F 1/12 273/149 R
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,844,930 B2 9/2014 Sampson
8,844,931 B2 * 9/2014 Blaha ..... A63F 1/12 273/149 R
8,899,587 B2 * 12/2014 Grauzer ..... A63F 1/12 273/149 R
8,919,775 B2 12/2014 Wadds et al.
8,960,674 B2 * 2/2015 Stasson ..... A63F 1/12 273/149 R
9,101,821 B2 8/2015 Snow
9,220,972 B2 * 12/2015 Grauzer ..... A63F 1/12
9,251,661 B2 2/2016 Tammesoo
9,266,012 B2 2/2016 Grauzer
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 * 2/2017 Stasson ..... A63F 1/12
9,679,603 B2 6/2017 Kelly et al.
9,731,190 B2 8/2017 Sampson et al.
10,238,954 B2 * 3/2019 Stasson ..... A63F 1/12
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 * 4/2003 Blaha ..... A63F 1/12 273/149 R
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108255 A1 6/2004 Johnson

(56) References Cited

U.S. PATENT DOCUMENTS

| | | | |
|---|---|---|---|
| 2004/0108654 | A1 | 6/2004 | Grauzer et al. |
| 2004/0116179 | A1 | 6/2004 | Nicely et al. |
| 2004/0169332 | A1 | 9/2004 | Grauzer et al. |
| 2004/0180722 | A1 | 9/2004 | Giobbi |
| 2004/0224777 | A1 | 11/2004 | Smith et al. |
| 2004/0245720 | A1 | 12/2004 | Grauzer et al. |
| 2004/0259618 | A1 | 12/2004 | Soltys et al. |
| 2005/0012671 | A1 | 1/2005 | Bisig |
| 2005/0012818 | A1 | 1/2005 | Kiely et al. |
| 2005/0023752 | A1 | 2/2005 | Grauzer et al. |
| 2005/0026680 | A1 | 2/2005 | Gururajan |
| 2005/0035548 | A1 | 2/2005 | Yoseloff |
| 2005/0037843 | A1 | 2/2005 | Wells et al. |
| 2005/0040594 | A1 | 2/2005 | Krenn et al. |
| 2005/0051955 | A1 | 3/2005 | Schubert et al. |
| 2005/0051956 | A1 | 3/2005 | Grauzer et al. |
| 2005/0062227 | A1 | 3/2005 | Grauzer et al. |
| 2005/0062228 | A1 | 3/2005 | Grauzer et al. |
| 2005/0062229 | A1 | 3/2005 | Grauzer et al. |
| 2005/0082750 | A1 | 4/2005 | Grauzer et al. |
| 2005/0093231 | A1 | 5/2005 | Grauzer et al. |
| 2005/0104289 | A1 | 5/2005 | Grauzer et al. |
| 2005/0104290 | A1 | 5/2005 | Grauzer et al. |
| 2005/0110210 | A1 | 5/2005 | Soltys et al. |
| 2005/0113166 | A1 | 5/2005 | Grauzer et al. |
| 2005/0113171 | A1 | 5/2005 | Hodgson |
| 2005/0119048 | A1 | 6/2005 | Soltys |
| 2005/0121852 | A1 | 6/2005 | Soltys et al. |
| 2005/0137005 | A1 | 6/2005 | Soltys et al. |
| 2005/0140090 | A1 | 6/2005 | Breeding et al. |
| 2005/0146093 | A1 | 7/2005 | Grauzer et al. |
| 2005/0148391 | A1 | 7/2005 | Tain |
| 2005/0164759 | A1 | 7/2005 | Smith et al. |
| 2005/0164761 | A1 | 7/2005 | Tain |
| 2005/0192092 | A1 | 9/2005 | Breckner et al. |
| 2005/0206077 | A1 | 9/2005 | Grauzer et al. |
| 2005/0242500 | A1 | 11/2005 | Downs |
| 2005/0272501 | A1 | 12/2005 | Tran et al. |
| 2005/0277463 | A1 | 12/2005 | Knust |
| 2005/0288083 | A1 | 12/2005 | Downs |
| 2005/0288086 | A1 | 12/2005 | Schubert et al. |
| 2006/0027970 | A1 | 2/2006 | Kyrychenko |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0055114 | A1 | 3/2006 | White et al. |
| 2006/0063577 | A1 | 3/2006 | Downs, III et al. |
| 2006/0066048 | A1 | 3/2006 | Krenn et al. |
| 2006/0084502 | A1 | 4/2006 | Downs et al. |
| 2006/0151946 | A1 | 7/2006 | Ngai |
| 2006/0181022 | A1 | 8/2006 | Grauzer et al. |
| 2006/0183540 | A1 | 8/2006 | Grauzer et al. |
| 2006/0189381 | A1 | 8/2006 | Daniel et al. |
| 2006/0199649 | A1 | 9/2006 | Soltys et al. |
| 2006/0205508 | A1 | 9/2006 | Green |
| 2006/0220312 | A1 | 10/2006 | Baker et al. |
| 2006/0220313 | A1 | 10/2006 | Baker et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281534 | A1 | 12/2006 | Grauzer et al. |
| 2007/0001395 | A1 | 1/2007 | Gioia et al. |
| 2007/0006708 | A1 | 1/2007 | Laakso |
| 2007/0015583 | A1 | 1/2007 | Tran |
| 2007/0018389 | A1 | 1/2007 | Downs, III |
| 2007/0045959 | A1 | 3/2007 | Soltys |
| 2007/0049368 | A1 | 3/2007 | Kuhn et al. |
| 2007/0057454 | A1 | 3/2007 | Fleckenstein |
| 2007/0057469 | A1 | 3/2007 | Grauzer et al. |
| 2007/0066387 | A1 | 3/2007 | Matsuno et al. |
| 2007/0069462 | A1 | 3/2007 | Downs, III et al. |
| 2007/0072677 | A1 | 3/2007 | Lavoie et al. |
| 2007/0102879 | A1 | 5/2007 | Stasson |
| 2007/0111773 | A1 | 5/2007 | Gururajan et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0241498 | A1 | 10/2007 | Soltys |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0278739 | A1 | 12/2007 | Swanson |
| 2007/0287534 | A1 | 12/2007 | Fleckenstein |
| 2007/0290438 | A1 | 12/2007 | Grauzer et al. |
| 2007/0298865 | A1 | 12/2007 | Soltys |
| 2008/0004107 | A1 | 1/2008 | Nguyen et al. |
| 2008/0006997 | A1 | 1/2008 | Scheper et al. |
| 2008/0006998 | A1 | 1/2008 | Grauzer et al. |
| 2008/0022415 | A1 | 1/2008 | Kuo et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0096656 | A1 | 4/2008 | LeMay et al. |
| 2008/0111300 | A1 | 5/2008 | Czyzewski et al. |
| 2008/0113700 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama et al. |
| 2009/0026700 | A2 | 1/2009 | Shigeta |
| 2009/0048026 | A1 | 2/2009 | French |
| 2009/0054161 | A1 | 2/2009 | Schuber et al. |
| 2009/0072477 | A1 | 3/2009 | Tseng et al. |
| 2009/0121429 | A1 | 3/2009 | Walsh et al. |
| 2009/0091078 | A1 | 4/2009 | Grauzer et al. |
| 2009/0100409 | A1 | 4/2009 | Toneguzzo |
| 2009/0104963 | A1 | 4/2009 | Burman |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh et al. |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho et al. |
| 2009/0267297 | A1 | 10/2009 | Blaha et al. |
| 2009/0283969 | A1 | 11/2009 | Tseng et al. |
| 2009/0298577 | A1 | 12/2009 | Gagner et al. |
| 2009/0302535 | A1 | 12/2009 | Ho et al. |
| 2009/0302537 | A1 | 12/2009 | Ho et al. |
| 2009/0312093 | A1 | 12/2009 | Walker et al. |
| 2009/0314188 | A1 | 12/2009 | Toyama et al. |
| 2010/0013152 | A1 | 1/2010 | Grauzer |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |

(56) References Cited

U.S. PATENT DOCUMENTS

| | | | |
|---|---|---|---|
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer |
| 2011/0006480 | A1 | 1/2011 | Grauzer |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta |
| 2011/0078096 | A1 | 3/2011 | Bounds |
| 2011/0079959 | A1 | 4/2011 | Hartley |
| 2011/0105208 | A1 | 5/2011 | Bickley |
| 2011/0109042 | A1 | 5/2011 | Rynda |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230148 | A1 | 9/2011 | Demuynck et al. |
| 2011/0230268 | A1 | 9/2011 | Williams |
| 2011/0233863 | A1 | 9/2011 | Toyama |
| 2011/0254222 | A1* | 10/2011 | Blaha ..... A63F 1/12 273/149 R |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0023318 | A1 | 1/2013 | Abrahamson |
| 2013/0026709 | A1 | 1/2013 | Sampson et al. |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0241147 | A1 | 9/2013 | McGrath |
| 2013/0300059 | A1 | 11/2013 | Sampson et al. |
| 2013/0337922 | A1 | 12/2013 | Kuhn |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2014/0346732 | A1 | 11/2014 | Blaha et al. |
| 2015/0021242 | A1 | 1/2015 | Johnson |
| 2015/0069699 | A1 | 3/2015 | Blazevic |
| 2015/0196834 | A1 | 7/2015 | Snow |
| 2015/0238848 | A1 | 8/2015 | Kuhn et al. |
| 2015/0251079 | A1 | 9/2015 | Wright |
| 2015/0290528 | A1 | 10/2015 | Sampson et al. |
| 2015/0290529 | A1 | 10/2015 | Bourbour et al. |
| 2017/0157499 | A1 | 6/2017 | Krenn et al. |
| 2018/0085658 | A1 | 3/2018 | Helsen et al. |
| 2018/0089956 | A1 | 3/2018 | Nagaragatta et al. |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 9/1996 |
| CA | 2284017 | A1 | 9/1998 |
| CA | 2612138 | A1 | 12/2006 |
| CA | 2823738 | A1 | 2/2015 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 101044520 | A | 9/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CZ | 24952 | U1 | 2/2013 |
| DE | 0291230 | C | 4/1916 |
| DE | 2816377 | A1 | 10/1979 |
| DE | 3807127 | A1 | 9/1989 |
| DE | 2757341 | A1 | 9/1998 |
| EP | 0777514 | B1 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 337147 | A | 9/1929 |
| GB | 414014 | A | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003154320 | A | 5/2003 |
| JP | 2003250950 | A | 9/2003 |
| JP | 2005198668 | A | 7/2005 |
| JP | 2006-092140 | A | 4/2006 |
| JP | 2008246061 | A | 10/2008 |
| JP | 4586474 | B2 | 11/2010 |
| TW | M335308 | U | 7/2008 |
| TW | M357307 | U | 5/2009 |
| TW | M359356 | U | 6/2009 |
| TW | I345476 | B2 | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |

(56) References Cited

FOREIGN PATENT DOCUMENTS

| | | | |
|---|---|---|---|
| WO | 9952610 | A1 | 10/1999 |
| WO | 9952611 | A1 | 10/1999 |
| WO | 200051076 | A1 | 8/2000 |
| WO | 0156670 | A1 | 8/2001 |
| WO | 0178854 | A3 | 10/2001 |
| WO | 0205914 | A1 | 1/2002 |
| WO | 03004116 | A1 | 1/2003 |
| WO | 03026763 | A1 | 4/2003 |
| WO | 2004067889 | A1 | 12/2004 |
| WO | 2004112923 | A1 | 12/2004 |
| WO | 2006031472 | A2 | 3/2006 |
| WO | 2006039308 | A2 | 4/2006 |
| WO | 2008005285 | A2 | 1/2008 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010052573 | A2 | 5/2010 |
| WO | 2010055328 | A2 | 5/2010 |
| WO | 2010117446 | A2 | 10/2010 |
| WO | 2012/053074 | A1 | 4/2012 |
| WO | 2013019677 | A2 | 2/2013 |
| WO | 2016058085 | A9 | 4/2016 |

OTHER PUBLICATIONS

Canadian Office Action for Canadian Application No. 2,461,726, dated Jul. 19, 2010, 3 pages.
Canadian Office Action for Canadian Application No. 2,461,726, dated Dec. 11, 2013, 3 pages.
CasinoTrac TableTrac Services. Product Information Datasheet [online]. CasinoTrac, 2015. Retrieved on Oct. 12, 2016 from the Internet: <URL: http://www.tabletrac.com/?pageid=15#prettyPhoto> (3 pages).
Christos Stergiou and Dimitrios Siganos, "Neural Networks," http://www.doc.ic.ac.uk/~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, civil Action No. CV 2:12-cv-01782-GMC-VCF, Oct. 10, 2012, 62 pages.
Connect2Table Administrator Manual, Jan. 7, 2013 (82 pages).
Connect2Table Quick Installation Guide, Feb. 20, 2013 (36 pages).
Connect2Table Connect2Table System Summary, generated Oct. 21, 2016 (2 pages).
Connect2Table User Manual, Feb. 7, 2013 (35 pages).
European Search Report for European Application No. 12 152 303, dated Apr. 16, 2012, 3 pages.
European Patent Application Search Report—European Patent Application No. 06772987.1, dated Dec. 10, 2009, 5 pages.
European Examination Report for European Application No. 02 780 410, dated Jan. 25, 2010, 5 pages.
European Examination Report for European Application No. 02 780 410, dated Aug. 9, 2011, 4 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may-2012/article/talking-tables> (4 pages).
Genevieve Orr, CS-449: Neural Networks Willamette University, http://www.willamette.edu/~gorr/classes/cs449/intro.html (4 pages), Fall 1999.
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.
Gros, Roger; New Card Management System to Be Tested at Bally's Park Place; Casino Journal; Apr. 1989; 5 pages.
http://www.google.com/search?tbm=pts&q=Card+handling+devicve+with+input+and+outpu . . . Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=shuffling+zone+onOopposite+site+of+input+. . . Jul. 18, 2012.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, dated May 9, 2009, 4 pages.
NEON Product Information Datasheets [online]. "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
Olsen, Eddie; Automatic Shuffler ready for Atlantic City experiment; Blackjack Confidential; Jul./Aug. 1989; pp. 6-7.
PCT International Preliminary Examination Report for International Patent Application No. PCT/US02/31105 dated Jul. 28, 2004, 9 pages.
PCT International Search Report for International Application No. PCT/US2003/015393, dated Oct. 6, 2003, 2 pages.
PCT International Search Report and Written Opinion, PCT/US2012/48706, dated Oct. 16, 2012, 12 pages.
PCT International Search Report for PCT/US2005/034737 dated Apr. 7, 2006, 1 page (WO06/039308).
PCT International Search Report for PCT/US2007/022894, dated Jun. 11, 2008, 3 pages.
PCT International Search Report and Written Opinion of the International Searching Authority for PCT/US2010/001032, dated Jun. 16, 2010, 11 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion, PCT Application No. PCT/US2015/051038, dated Jan. 22, 2016, 11 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015, 13 pages.
PCT International Search Report and Written Opinion for International Application No. PCT/US2007/023168, dated Sep. 12, 2008, 8 pages.
PCT International Search Report and Written Opinion, PCT Application No. PCT/US2015/040196, dated Jan. 15, 2016, 20 pages.
PCT International Search Report and Written Opinion, PCT Application No. PCT/US2013/062391, dated Dec. 17, 2013, 13 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/025420, dated Oct. 2, 2015, 15 pages.
PCT International Search Report and Written Opinion of the International Searching Authority for PCT/US13/59665, dated Apr. 25, 2014, 21 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion for International Application No. PCT/US2007/022858, dated Mar. 7, 2008, 7 pages.
PCT International Search Report and Written Opinion for International Patent Application No. PCT/US2006/22911, dated Jun. 1, 2007, 6 pages.
PCT International Search Report and Written Opinion of the International Searching Authority for PCT/GB2011/051978, dated Jan. 17, 2012, 11 pages.

(56) References Cited

OTHER PUBLICATIONS

⅓" B/W CCD Camera Module EB100 by EverFocus Electronics Corp., Jul. 31, 2001, 3 pgs.
"ACE, Single Deck Shuffler," Shuffle Master, Inc., (2005), 2 pages.
Advansys, "Player Tracking" http://advansys.si/products/tablescanner/player-tracking/[Sep. 23, 2016 1:41:34 PM], 4 pages.
Australian Examination Report for Australian Application No. 2015298294, dated Mar. 20, 2018, 5 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Title: Card Handling Apparatus, 13 pages.
"Automatic casino card shuffle," Alibaba.com, (last visited Jul. 22, 2014), 2 pages.
Bally Systems Catalogue, Ballytech.com/systems, 2012, 13 pages.
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
DVD labeled Exhibit 1. This is a DVD taken by Shuffle Master personnel of the live operation of a CARD One2Si Shuffler (Oct. 7, 2003). DVD sent to Examiner by US Postal Service with this PTO/SB/08 form.
DVD labeled Morrill Decl. Ex. A is (see Binder 4-1, p. 149/206, Morrill Decl., para. 2): A video (16 minutes) that the attorney for CARD, Robert Morrill, made to describe the Roblejo prototype card shuffler. DVD send to Examiner by US Postal Service with this PTO/SB/08 form
DVD labeled Solberg Decl.Ex.C, which is not a video at all, is (see Binder 4-1, p. 34/206, Solberg Decl., para.8): Computer source code for operating a computer-controlled card shuffler (an early Roblejo prototype card shuffler) and descriptive comments of how the code works. DVD sent to Examiner by US Postal Service with this PTO/SB/08 form.
DVD labeled Luciano Decl. Ex. K is (see Binder 2-1, p. 215/237, Luciano Decl., para.14): A video demonstration (11minutes) of a Luciano Packaging prototype shuffler. DVD sent to Examiner by US Postal Service with this PTO/SB/08 form.
"Error Back propagation," http://willamette.edu~gorr/classes/cs449/backprop.html (4 pages), Nov. 13, 2008.
"I-Deal," Bally Technologies, Inc., (2014), 2 pages.
"Shufflers—SHFL entertainment," Gaming Concepts Group, (2012), 6 pages.
"TAG Archives: Shuffle Machine," Gee Wiz Online, (Mar. 25, 2013), 4 pages.
Shuffle Master, Inc. (1996). Let It Ride, The Tournament, User Guide, 72 pages.
Philippines Patent Application Formality Examination Report—Philippines Patent Application No. 1-2006-000302, dated Jun 13, 2006.

(56) References Cited

OTHER PUBLICATIONS

"Playtech Retail begins roll out of Neon across Grosvenos 55 UK Casinos". Playtech, Apr. 21, 2016. Retrieved on Oct. 11, 2016 from the Internet: <URL: https://www.playtech.com/news/latest_news_and_prs/playtech_retail_begins_roll_out_of_neon_across_grosvenor_s_55_uk_casinos> (1 page).
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Prototype Glossary and Timelines; *Shuffle Tech International* v. *Scientific Games Corp., et al.* 1:15-cv-3702 (N.D. III.); undated; (May 2018) pp. 1-4.
Scarne's Encyclopedia of Games by John Scame, 1973, "Super Contract Bridge", p. 153.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Service Manual/User Manual for Single Deck Shufflers: BG1, BG2 and BG3 by Shuffle Master © 1997, 151 page.
Singapore Patent Application Examination Report—Singapore Patent Application No. SE 2008 01914 A, Jun. 18, 2008, 9 pages.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master's Reply Memorandum in Support of Shuffle Master's Motion for Preliminary Injunction for *Shuffle Master, Inc.* vs. *VendingData Corporation*, in the U.S. District Court, District of Nevada, No. CV-S-04-1373-JCM-LRl, Nov. 29, 2004.
*Shuffle Tech International LLC et al.* vs. *Scientific Games Corporation et al.*, Order Denying Motion for Summary Judgement: Memorandum Opinion and Order, In the U.S. District Court, for the Northern District of Illinois Eastern Division, No. 15 C 3702, Sep. 1, 2017, 35 pages.
Solberg, Halvard; Deposition; *Shuffle Tech International* v. *Scientific Games Corp., et al.* 1:15-cv-3702 (N.D. III.); Oct. 18, 2016; pp. 187, 224-246, 326-330, 338-339, 396; Baytowne Reporting; Panama City, FL.
Statement of Relevance of Cited References, Submitted as Part of a Third-Party Submission Under 37 CFR 1.290 on Dec. 7, 2012 (12 pages).
"TableScanner (TM) from ADVANSYS", Casino Inside Magazine, No. 30, pp. 34-36 (Dec. 2012) (4 pages).
TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).
TableScanner "Casino Management System". Product Information Datasheets [online]. Advansys, 2013. Retrieved on Oct. 11, 2016 from the Internet: <URL: http://advansys.si/> (6 pages).
TableScanner "Multisite". Product Information Datasheets [online]. Advansys, 2013. Retrieved on Oct. 11, 2016 from the Internet: <URL: http://advansys.si/products/tablescanner/multisite/> (3 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
TableScanner "Table Management system". Product Information Datasheets [online]. Advansys, 2013. Retrieved on Oct. 11, 2016 from the Internet: <URL: http://advansys.si/products/tablescanner/> (4 pages).
Tbm=pts&hl=en Google Search for card handling device with storage area, card removing system pivoting arm and processor : http://www.google.com/?tbrn=pts&hl=en; Jul. 28, 2012, 2 pages.
Tracking the Tables, by Jack Bularsky, Casino Journal, May 2004, vol. 17, No. 5, pp. 44-47.
"TYM @ A Glance—Table Games Yield Management", TYM LIVE Product Information Datasheets [online]. TANGAM Systems, 2016. Retrieved on Oct. 3, 2016 from the Internet: <URL: http://tangamgaming.com/wp-content/uploads/2016/12/TG_TYMGlance_2016-V4-1.pdf> (2 pages).
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, In the U.S. District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.
European Office Action from European Application No. 15744793.9, dated Mar. 21, 2019, 5 pages.
International Search Report from International Application No. PCT/US2019/027460, dated Aug. 12, 2019, 4 pages.
International Written Opinion from International Application No. PCT/US2019/027460, dated Aug. 12, 2019, 9 pages.
Taiwanese Office Action and Search Report from Taiwanese Application No. 104122818, dated Apr. 29, 2019, 17 pages.

* cited by examiner

METHODS OF MAKING AND USING HAND-FORMING CARD SHUFFLERS

CROSS-REFERENCE TO RELATED APPLICATIONS

This application is a continuation of U.S. patent application Ser. No. 15/377,573, filed Dec. 13, 2016, now U.S. Pat. No. 10,238,954, issued Mar. 26, 2019, which is a continuation of U.S. patent application Ser. No. 14/450,008, filed Aug. 1, 2014, now U.S. Pat. No. 9,566,501, issued Feb. 14, 2017, on behalf of Stasson et al., the disclosure of each of which is incorporated herein in its entirety by this reference.

TECHNICAL FIELD

The present disclosure relates to card shufflers for use in forming randomizing groups of playing cards, such as playing card hands for use in a playing card game, to methods of manufacturing such card shufflers, and to methods of using such card shufflers.

BACKGROUND

Card shufflers are used to randomize an order of cards in a stack of cards, and are frequently used in the gaming industry for use with playing cards, such as decks of standard playing cards which include four suits (i.e., clubs, diamond, hearts, and spades) of cards, wherein each suit includes a group of thirteen (13) differently ranked cards sequentially numbered from two (2) through ten (10), as well as a Jack, a Queen, a King, and an Ace. Such a standard deck of playing cards may also include one or more additional cards, such as two additional Jokers. Thus, a complete deck may comprise, for example, fifty-two (52) or fifty-four (54) playing cards.

Card shufflers are known in the art that, in addition to shuffling cards, may be used to sort cards into a predetermined order, such as what is referred to in the art as "new deck" order. To accomplish such a sorting operation, a card shuffler must be capable of accurately identifying indicia on each card, such as the rank and suit of standard playing cards and be capable of placing cards in a desired order with accuracy. Card shufflers capable of sorting cards often include a card imaging system, which may include a camera that acquires an image of each card. An algorithm may be used to analyze the image and compare the image to images of cards of known identity. By determining to which known image the acquired image most closely corresponds, the identity of each card may be determined and used by the card shuffler to sort cards into a predetermined order.

Many previously known card shufflers are not capable of truly randomizing an order of the cards in any given set of cards due to limitations in the mechanism or system used to shuffle the cards. Thus, there remains a need in the art for card shufflers that are capable of truly randomizing an order of cards in a set of cards to a sufficient degree to be considered random in the shuffler arts. Additionally, it may be desirable to shuffle and/or sort cards using a card shuffler quickly so as to increase the amount of shuffling and/or sorting operations that may be performed by a card shuffler in any given amount of time.

The Ace® card shuffler, offered by Shuffle Master, Inc. of Las Vegas, Nev. in the past, and as described in U.S. Pat. No. 6,149,154, is a batch-type card shuffler with a vertically moving rack comprising multiple compartments. This structure lacks card recognition. Shuffling is accomplished through random loading of the racks. Packs of cards are formed in compartments. The order in which the cards are delivered to hand-forming compartments is substantially random. However, the composition of the pack is random. Cards placed in the discard rack may not be randomly ordered. More than two cards are delivered to each compartment.

U.S. Pat. No. 6,267,248 describes a carousel-type card shuffler that uses a card imaging system to identify cards as they move from a card infeed tray to compartments in a rotatable carousel. The card shuffler randomly loads compartments in the carousel, and sequentially unloads the compartments. More than two cards may be delivered to each compartment. U.S. Pat. No. 6,651,981 describes a flush-mounted batch card shuffler that elevates shuffled cards to the game play surface. U.S. Pat. No. 7,677,565 describes a similar card shuffler that also includes card recognition capability. These card shufflers form a single stack of a shuffled deck or multiple decks. The stack formed in the shuffler is gripped at randomly selected elevations. A section of the stack of cards at the grippers and above is gripped at a randomly selected location in the stack. Cards beneath the grippers are lowered, which creates an insertion opening into the stack into which an additional card may be inserted to shuffle the cards. Products as described in these patents have been commercialized by Shuffle Master, Inc., which has now merged into Bally Gaming, Inc., under the product names DECK MATE® and MD2® and MD3™ card shufflers.

U.S. Pat. No. 7,766,332 describes a hand-forming card shuffler that includes card recognition capability. The device described in this patent has been commercialized by Shuffle Master, Inc., now merged into Bally Gaming, Inc., as the I-DEAL® card shuffler.

BRIEF SUMMARY

In some embodiments, the present disclosure includes a card shuffler that comprises a card input mechanism for inputting cards into the card shuffler, a card storage device for receiving cards from the card input mechanism and temporarily storing cards within the card shuffler, and a card output mechanism for outputting cards from the card shuffler. The card storage device includes a movable wheel configured to rotate within the automatic card shuffler. The movable wheel includes a plurality of card storage compartments, at least a majority of the card storage compartments sized and configured to hold two or more cards therein. The card output mechanism is configured to eject cards out from the card storage compartments and into a card output compartment such that the cards are oriented at a downward angle of between about 2° and about 15° relative to a horizontal plane at all times as the cards move from each card storage compartment and into the card output compartment.

In additional embodiments, the present disclosure includes a card shuffler comprising a card input mechanism for inputting cards into the card shuffler, a card storage device for receiving cards from the card input mechanism and temporarily storing cards within the card shuffler, and a card output mechanism for moving shuffled cards from the card storage device and outputting the shuffled cards from the card storage device. The card shuffler further includes a control system configured to control operation of the card shuffler. The control system includes a touch screen control panel configured to receive input information from an operator of the card shuffler and to output information to the operator of the card shuffler, as well as a player display mounted to the card shuffler. The control system is configured to display information to players of a playing card game in which the card shuffler is used on the player display.

In additional embodiments, the present disclosure includes a card shuffler comprising a card input receptacle, a card output receptacle, a card input mechanism for inputting cards into the card shuffler from the card input receptacle, a card storage device for receiving cards from the card input mechanism and temporarily storing cards within the card shuffler, and a card output mechanism for moving shuffled cards from the card storage device to the card output receptacle. The card shuffler also includes a drip pan located and configured to divert fluid spilled into at least one of the card input receptacle and the card output receptacle to an exterior of the card shuffler.

In additional embodiments, the present disclosure includes a card shuffler comprising a card input area, a card output area, a card input mechanism for inputting cards into the card shuffler from the card input area, a card storage device for receiving cards from the card input mechanism and temporarily storing cards within the card shuffler, and a card output mechanism for moving shuffled cards from the card storage device to the card output area. The card input mechanism includes a plurality of rollers located and configured to drive movement of cards along a card input path extending from the card input area to toward to the card storage device, and a motor configured to drive rotation of at least some rollers of the plurality of rollers. The card input mechanism further includes at least one slide bar extending continuously between the rollers of the plurality of rollers along the input path. The slide bar has an upper surface recessed from apexes of the rollers of the plurality of rollers by an average distance of about 0.07 inches or less.

In yet further embodiments, the present disclosure includes a card shuffler configured to generate a number of randomized playing card hands for use in a playing card game. The card shuffler includes a card input mechanism for inputting cards into the card shuffler, a card storage device for receiving cards from the card input mechanism and temporarily storing cards within the card shuffler, and a card output mechanism for moving shuffled cards from the card storage device and outputting the shuffled cards into a card delivery tray. The card storage device includes a plurality of card storage compartments, and at least a majority of the card storage compartments are sized and configured to hold two or more cards therein. The card shuffler further includes a control system configured to control operation of the card shuffler in a first operational mode during use of the card shuffler in a playing card game with at least a predefined number of players, and to control operation of the card shuffler in a second operational mode during use of the card shuffler in the playing card game with less than the predefined number of players. The control system is configured under control of a program to cause the card shuffler to form playing card hands in a first number of designated adjacent card storage compartments of the plurality of card storage compartments in the first operational mode, and the control system is configured under control of the program to form playing card hands only in a second number of designated adjacent card storage compartments of the plurality of card storage compartments and not in any other card storage compartments of the plurality of card storage compartments in the second operational mode. The second number is lower than the first number.

In additional embodiments, the present disclosure includes a card shuffler configured to generate a number of randomized playing card hands for use in a playing card game. The card shuffler includes a card input mechanism for inputting cards into the card shuffler, a card storage device for receiving cards from the card input mechanism and temporarily storing cards within the card shuffler, and a card output mechanism for moving shuffled cards from the card storage device and outputting the shuffled cards into a card delivery tray. The card storage device includes a plurality of card storage compartments, and each card storage compartment is sized and configured to hold two or more cards therein. A control system is configured to control operation of the card shuffler. The card shuffler further includes a printer operationally coupled with the control system, and the control system is configured under control of a program to cause the printer to print information onto a printable medium using the printer. The information is usable in verifying a winning playing card hand generated by the card shuffler in a round of game play.

In additional embodiments, the present disclosure includes a card shuffler configured to generate a number of randomized playing card hands for use in a playing card game. The card shuffler includes a card input mechanism for inputting cards into the card shuffler, a card storage device for receiving cards from the card input mechanism, and a card output mechanism for moving shuffled cards from the card storage device and outputting the shuffled cards into a card delivery tray. The card shuffler further includes at least one light-generating device located within the card shuffler and configured to generate light within the card shuffler. In some embodiments of the disclosure, the light generated by the light-generating device is not used by any sensor of the card shuffler. In other embodiments, the light source is used by the card reading sensor, such as a CMOS or CCD sensor. The light source may be pulsed, activated during a card distribution cycle, activated in response to a triggering event such as card movement, or turned on while the machine is in operation.

In yet further embodiments, the present disclosure includes a method of using a card shuffler configured to generate a number of randomized playing card hands for use in a playing card game. In accordance with the method, the card shuffler is used to generate randomized playing card hands. The playing card hands are dispensed from the card shuffler, and the playing card hands are used in a playing card game. Information relating to the playing card hands or the playing card game is stored in a memory device of a control system of the card shuffler. Upon randomly dealing a winning hand of predefined composition, the information is transmitted from the card shuffler to a remote server in response to a signal generated by the control system of the card shuffler to indicate that the winning hand has been dealt to the remote server. Transmission may occur wirelessly or through hard wired transmission lines or busses.

In additional embodiments, the present disclosure includes a method of using a card shuffler configured to generate a number of randomized playing card hands for use in a playing card game. In accordance with the method, the card shuffler is used to generate randomized playing card hands. The playing card hands are dispensed from the card shuffler, and the playing card hands are used in a playing card game. Information relating to at least one of the playing card hands and the playing card game is stored in a memory device of a control system of the card shuffler. A modem operatively coupled with the control system of the card shuffler is used to receive information from a remote server and transmit information to the remote server. The sent and received information includes a software verification algorithm used to verify an identity of software installed in the memory device of the control system.

In additional embodiments, the present disclosure includes a method of using a card shuffler configured to generate a number of randomized playing card hands for use in a playing card game. In accordance with the method, a stack of unshuffled playing cards is placed into a card input area of the card shuffler. The stack of unshuffled playing cards includes at least one security card that may not be usable in the playing card game. The card shuffler is used to generate randomized playing card hands in card storage compartments within a card storage device of the card shuffler. The card shuffler is used to position the at least one security card adjacent at least one formed randomized playing card hand from one of the card storage compartments within the card storage device. In one embodiment of the disclosure, a security card is temporarily stored in a dedicated storage compartment and is transferred to the card output area prior to transferring the group of cards designated as a dealer hand. In another embodiment, a security card is positioned in a compartment and a group of cards to be designated as a dealer hand is placed over the security card in the compartment, after which the dealer hand with security card on the bottom is transferred to the card output area. The playing card hands are also dispensed from the card storage device into the card output area of the card shuffler. When the dealer hand is delivered to a position on the gaming table, the lowermost card in the hand is masked from the view of the players by the security card. More than one compartment may be designated to receive only a security card.

DETAILED DESCRIPTION

The illustrations presented herein are not meant to be actual views of any particular card shuffler or component thereof, but are merely idealized representations that are used to describe embodiments of the disclosure.

As used herein, the term "shuffle," when used with reference to cards, means to randomize an order of cards in a stack of cards.

As used herein, the term "card" means a physical playing card for use in a playing card games.

Figure 1:
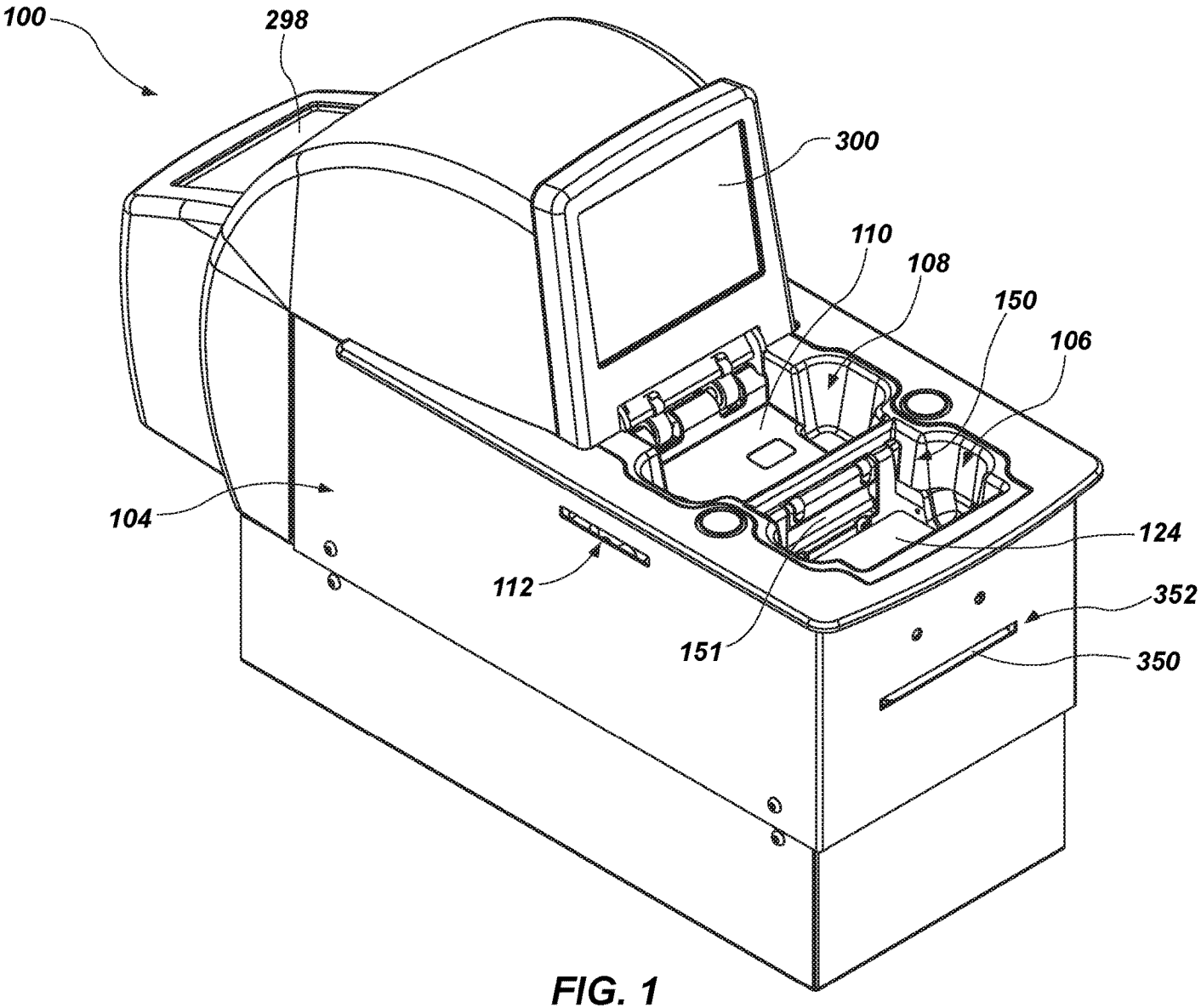
FIG. 1 is a perspective view of an embodiment of a card shuffler.

FIG. 1 is a perspective view of an automatic card shuffler 100. The card shuffler 100 is configured to automatically generate and form randomized groups of playing card hands. The cards may be playing cards for use in playing card games. The card shuffler 100 may be particularly useful in what are referred to in the art as "specialty games," in which playing card hands are formed and dealt to players of the game, which may include the dealer in some games. Common cards may be delivered, groups of cards that must be set into multiple dealer cards, partial hands, and one or more extra cards may be delivered to complete a partial hand. Such games include, but are not limited to, LET IT RIDE®, THREE CARD POKER, FOUR CARD POKER, ULTIMATE TEXAS HOLD'EM®, MISSISSIPPI STUD®, and PAI GOW POKER. The card shuffler 100 also may be employed in other types of games, such as Blackjack, for example.

The card shuffler 100 may be capable of performing additional operations on one or more cards inserted into the card shuffler 100. For example, the card shuffler 100 may be configured to sort cards in a stack of cards inserted into the card shuffler 100 into a predefined order, although the card order within a particular compartment may not be arranged in a desired order. For example, the shuffler may be programmed to deliver random hands. The order of cards within the compartment is unimportant, as the group of cards will be rearranged by the players and/or the dealer during play. When the shuffler is configured to sort cards into a predetermined order such as pack order, only two cards may be inserted into each compartment. As will be more fully described below, when a compartment already has a card present, the device is configured to insert a next card above or below the card that is already inserted. Since a third card cannot be inserted between a first and second card already in the compartment, it is desirable to use enough compartments to enable the use of each compartment to receive only two cards. Using this method, the exact order of the cards after recombining all groups of cards in the output area is identical to the predicted order.

The card shuffler 100 may be configured to verify the presence or absence of cards in a predefined set of different cards having one or more distinguishing characteristics (e.g., rank and/or suit of standard playing cards and/or special card markings). The card shuffler 100 may be configured to detect and identify cards that are damaged to allow the entire deck to be replaced, or for damaged cards to be removed and replaced prior to use of the set of cards in a playing card game. Thus, although the card handling machine is referred to herein as a card "shuffler," it may also be characterized as a card sorter, a card verifier, etc.

As discussed in further detail below, the card shuffler 100 includes an internal card storage device, a card input mechanism for moving cards from a card input area into the internal card storage device, and a card output mechanism for moving cards from the internal card storage device to a card output area. The card shuffler 100 also may include a card reading system for capturing data from one or more images of cards inserted into the card shuffler 100. Examples of suitable card reading systems include complementary metal-oxide-semiconductor (CMOS) two-dimensional (2D) imaging systems and contact image sensor (CIS), CMOS line scanners and CCD imagers. The card shuffler 100 further includes a control system for controlling the various active components of the card shuffler 100, for receiving input from a user of the card shuffler 100, and for outputting information to a user of the card shuffler 100.

Figure 3:
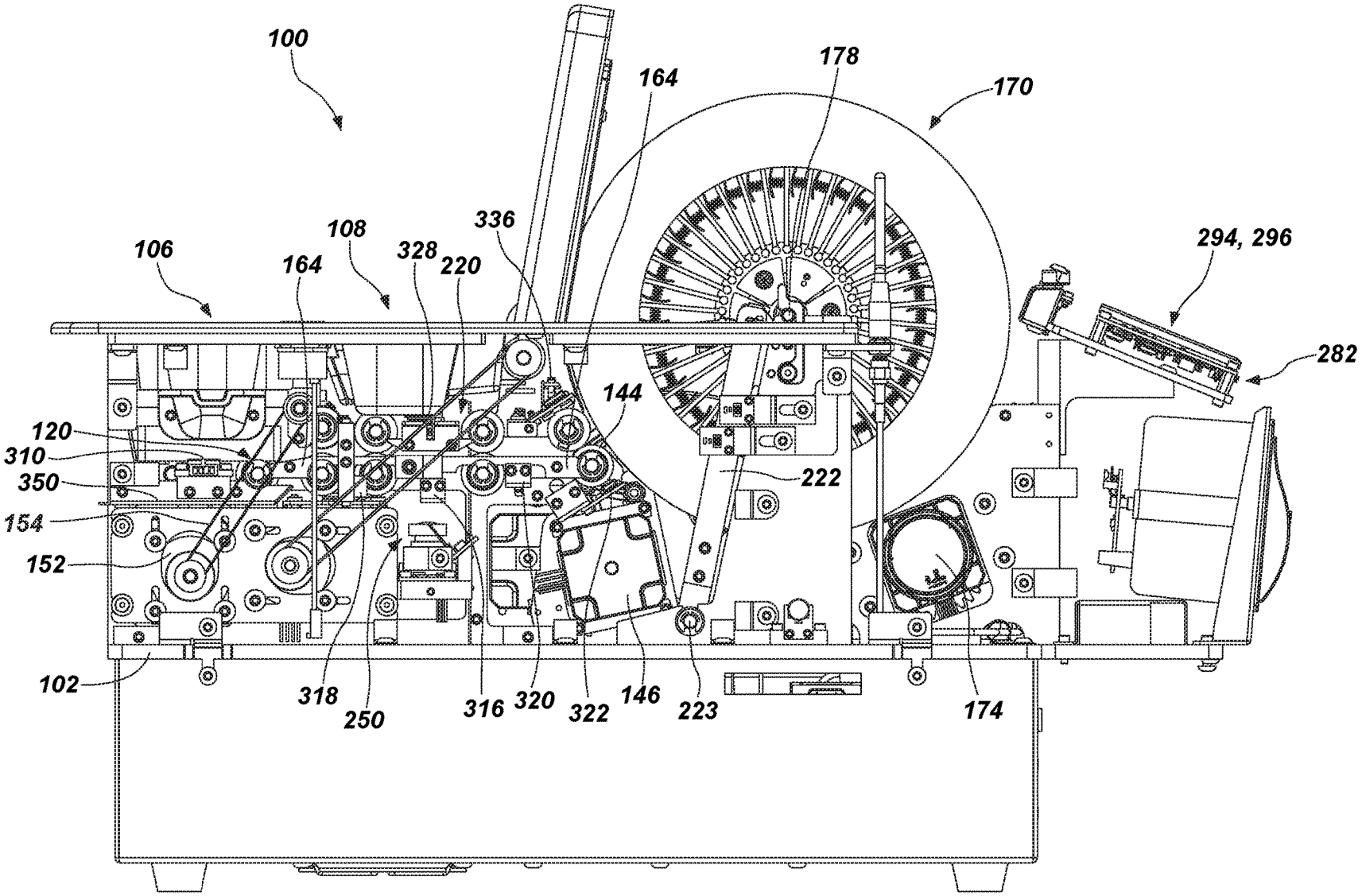
FIG. 3 is a first side view of the card shuffler of FIG. 1 with cover members removed to reveal internal components of the card shuffler.

Referring briefly to FIG. 3, the card shuffler 100 includes an internal structural frame 102, to which the various components of the card shuffler 100 may be directly or indirectly coupled. The frame 102 may comprise a plurality of members that may be coupled together to form the frame 102. Referring again to FIG. 1, an outer cover 104 may be coupled to the internal structural frame 102 around the internal components of the card shuffler 100. The outer cover 104 covers and protects the internal components of the card shuffler 100. The card shuffler 100 includes a card input area 106 and a separate card output area 108. Cards to be shuffled may be assembled into a first stack, which may be placed into the card input area 106. After shuffling or sorting the cards, the card shuffler 100 may automatically deliver a second stack (which may be a playing card hand, a shuffled deck of cards, a sorted deck of cards, etc.) to the card output area 108.

Figure 2:
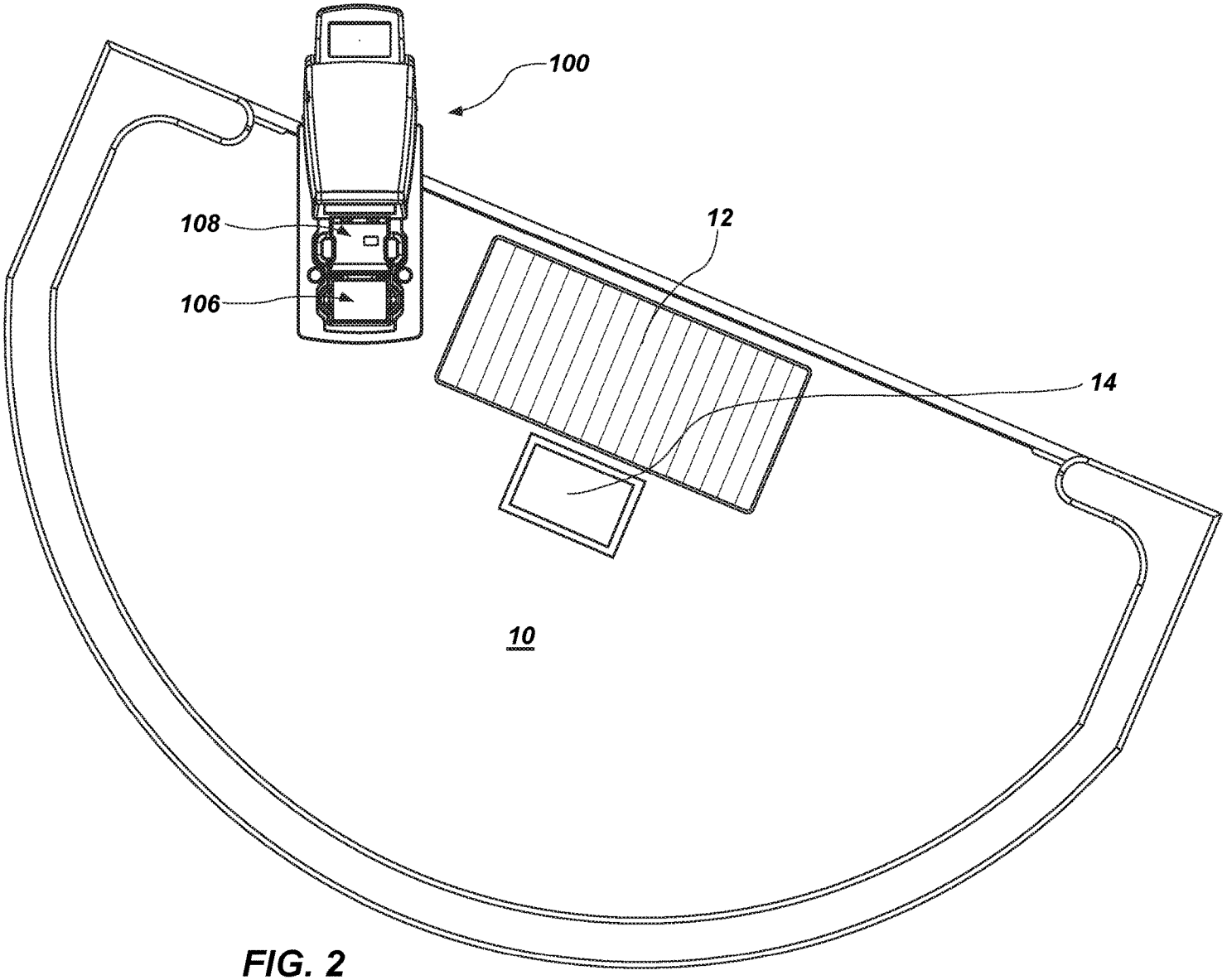
FIG. 2 is a top plan view of a card playing table having the card shuffler of FIG. 1 mounted thereto.

Referring to FIG. 2, the card shuffler 100 may be configured to be mounted to a surface of a playing card table 10 proximate a dealer station 12. In some embodiments, the shuffler 100 is in communication with a separate common display device 14 which may be used to provide the dealer with instructions for administering the game, or may provide the player with instructions, such as setting hands of cards a "house way" in a game of Pai Gow Poker, for example. The hand composition is sensed by the shuffler 100 and this information is used by the processor (not shown) that is programmed with "house way" rules to determine how to set the hand. The details of how the display device 14 and shuffler 100 work together as an integrated system to administer certain types of card games is fully disclosed in U.S. Pat. No. 8,342,529, the disclosure of which is hereby incorporated in its entirety by reference.

In some embodiments, the card shuffler 100 may include a locking mechanism that may be used to lock the card shuffler 100 to the playing card table 10 to prevent unauthorized removal of the card shuffler 100 from the playing card table 10. For example, as shown in FIG. 1, the cover 104 may include a slot 112 through which a locking lever may extend upon rotation of a key in a keyhole (not shown). The keyhole may be accessible only by removing the cover 104, in some embodiments. Thus, the cover 104 (or at least a portion of the cover 104) may be removed, and the card shuffler 100 may be positioned on the playing card table 10. The key may be inserted into the keyhole and rotated to cause a lever to rotate or otherwise extend laterally from the side of the card shuffler 100 under the lower surface of the table 10. The key then may be removed from the keyhole, and the cover 104 may be locked securely on the shuffler 100. In this configuration, it may be difficult or impossible to remove the shuffler 100 from the table 10 without damaging the table 10 and/or the shuffler 100.

Figure 4:
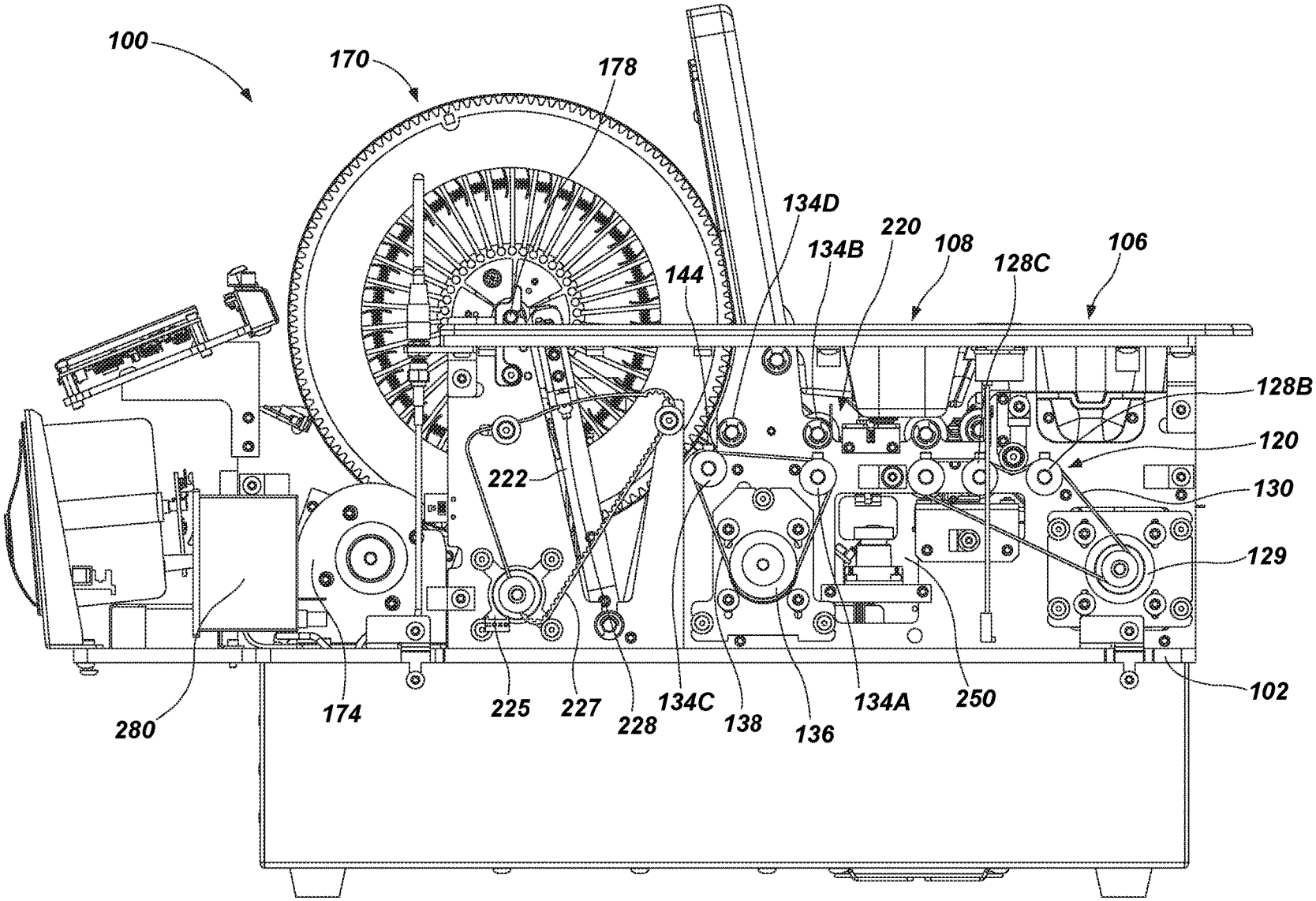
FIG. 4 is a second side view of the card shuffler of FIG. 1 with cover members removed to reveal internal components of the card shuffler.

FIGS. 3 and 4 illustrate the card shuffler 100 with the outer cover 104 and other components, such as frame members, removed from the view to reveal internal components and mechanisms of the card shuffler 100. As shown in FIG. 3, the card shuffler 100 includes a card input mechanism 120, a card storage device 170 for temporarily storing cards within the card shuffler 100, and a card output mechanism 220. The card input mechanism 120 is configured to move cards from the card input area 106 (FIG. 1) into the card storage device 170, and the card output mechanism 220 is configured to move cards from the card storage device 170 to the card output area 108 (FIG. 1).

Figure 5:
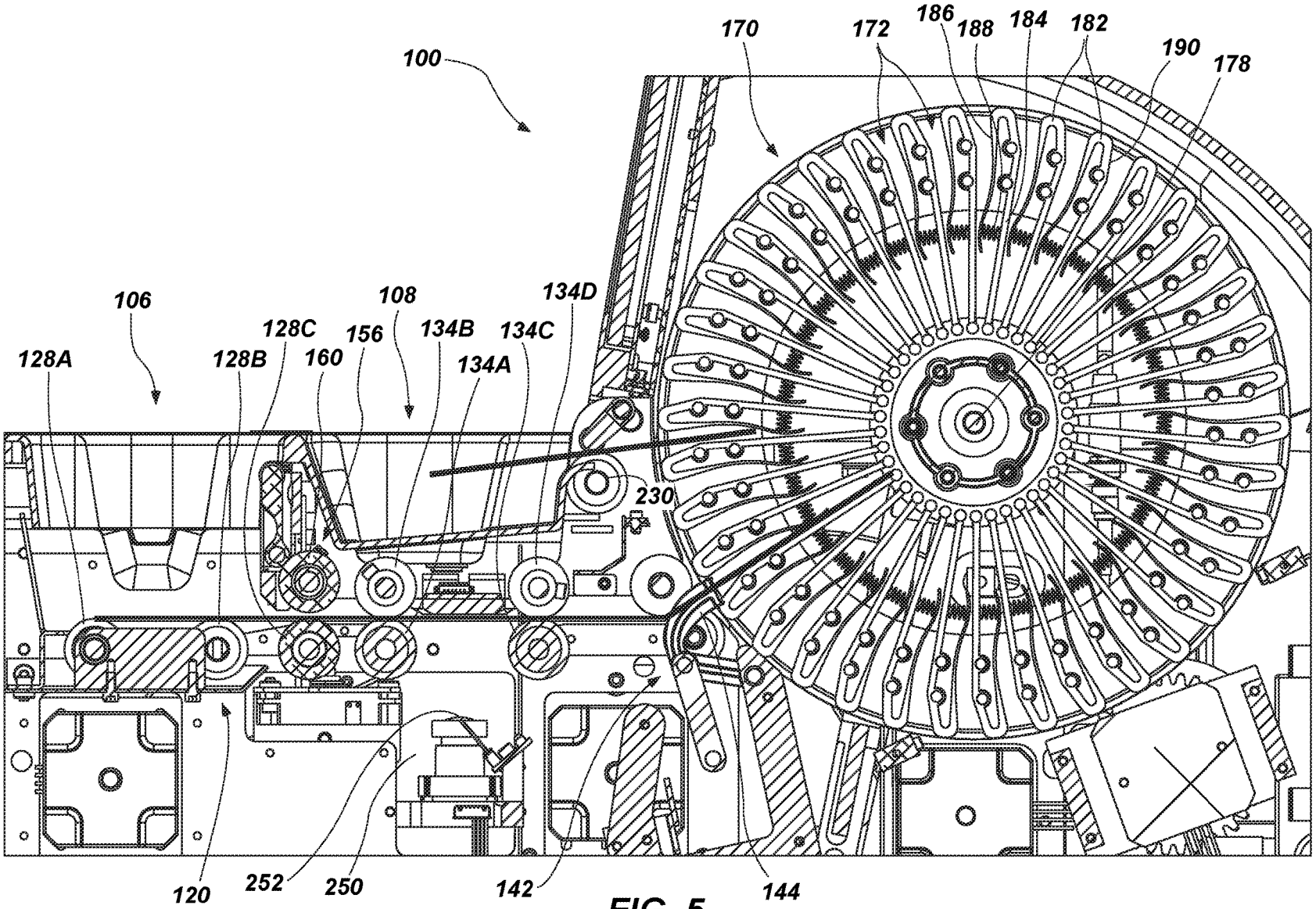
FIG. 5 is a partial, enlarged cross-sectional side view of the card shuffler of FIG. 1.

The card input mechanism 120 includes a card support 124 (FIG. 1) that provides a base for the card input area 106. Cards placed in the card input area are supported by pick-off rollers 128A, 128B that extend into the card input area 106. The feed rollers support a stack of cards placed thereon. FIG. 5 is an enlarged, partial cross-sectional side view taken through the card shuffler 100. As shown therein, the card input mechanism 120 includes one or more pick-off rollers 128A-128C. The pick-off rollers 128A-128E are used to sequentially move a bottom card in a stack of cards resting on the pick-off rollers above the card support 124 (FIG. 1) out from the stack of cards in a lateral, substantially horizontal direction toward the card storage device 170. Two or more of the pick-off rollers 128A-128E may be driven in unison by a motor 129 using a belt 130 (FIG. 4) engaged with complementary pulleys mounted on axles carrying the pick-off rollers 128A-128E. One or more of the pick-off rollers 128A-128E, such as the pick-off roller 128A, optionally may comprise an idler roller that is not driven by the motor 129, but rather idly rolls along the surface of a card moving past the idler roller responsive to rotation of other driven pick-off rollers, such as 128B and 128C, driven by the motor 129.

With continued reference to FIG. 5, the card input mechanism 120 may further include a brake roller assembly 156 that includes a brake roller 160 mounted on an axle attached to a bracket, and may be disposed proximate the pick-off roller 128C so as to dispose a card gap between the brake roller 160 and the pick-off roller 128C through which cards pass as they move through the card input mechanism 120 toward the card storage device 170. The vertical position of the brake roller 160 may be adjustable to selectively adjust the thickness of the card gap between the brake roller 160 and the pick-off roller 128C. Using the adjustable brake roller assembly 156, the card shuffler 100 may be adapted for use with cards of different thicknesses. The vertical position of the brake roller 160 may be selectively adjusted until the card gap is sized to allow a single card to pass through the card gap, but to prevent two or more cards from passing together through the card gap at the same time. In this matter, the brake roller 160 sequentially breaks single cards away from the stack of cards supported by the pick-off rollers 128A, 128B above the card support 124 of the card input mechanism 120 one card at a time.

With continued reference to FIGS. 4 and 5, the card input mechanism 120 further includes one or more speed-up rollers 134A-134D, and a motor 136 configured to drive rotation of one or more of the speed-up rollers 134A-134D. The speed-up rollers 134A-134D are used to accept a card from the pick-off rollers 128A-128C, and to insert the card into the card storage device 170. The speed-up rollers 134A-134D may be located and configured to contact and grab a leading edge of a card just prior to the point at which a trailing edge of the card passes beyond and is released from the pick-off rollers 128A-128C. Thus, as the leading edge of the card contacts the speed-up rollers 134A-134D, as controlled and determined by selective rotation of the pick-off rollers 128A-128C, the card will be grabbed and pulled out from the pick-off rollers 128A-128C and inserted into the card storage device 170 by the speed-up rollers 134A-134D.

As with the pick-off rollers 128A-128E, two or more of the speed-up rollers 134A-134D may be driven in unison by the motor 136 using a belt 138 (FIG. 4) engaged with complementary pulleys mounted on axles carrying the speed-up rollers 134A-134D. One or more of the speed-up rollers 134A-134D, such as the speed-up roller 134B and the speed-up roller 134D, optionally may comprise idler rollers that are not driven by the motor 136, but rather idly roll along the surface of a card moving past the idler roller responsive to rotation of other driven speed-up rollers, such as 134A and 134C, driven by the motor 136.

During operation of the card shuffler 100, the speed-up rollers 134A-134D may be continuously rotated at a substantially constant rotational speed. Rotation of the pick-off rollers 128A-128C, however, may be selectively started and stopped by a control system 280 (FIG. 4) of the card shuffler 100. When rotation of the pick-off rollers 128A-128E is commenced, the pick-off rollers 128A-128E may rotate at a rotational speed that is less than the rotational speed of the speed-up rollers 134A-134D.

Figure 9A:
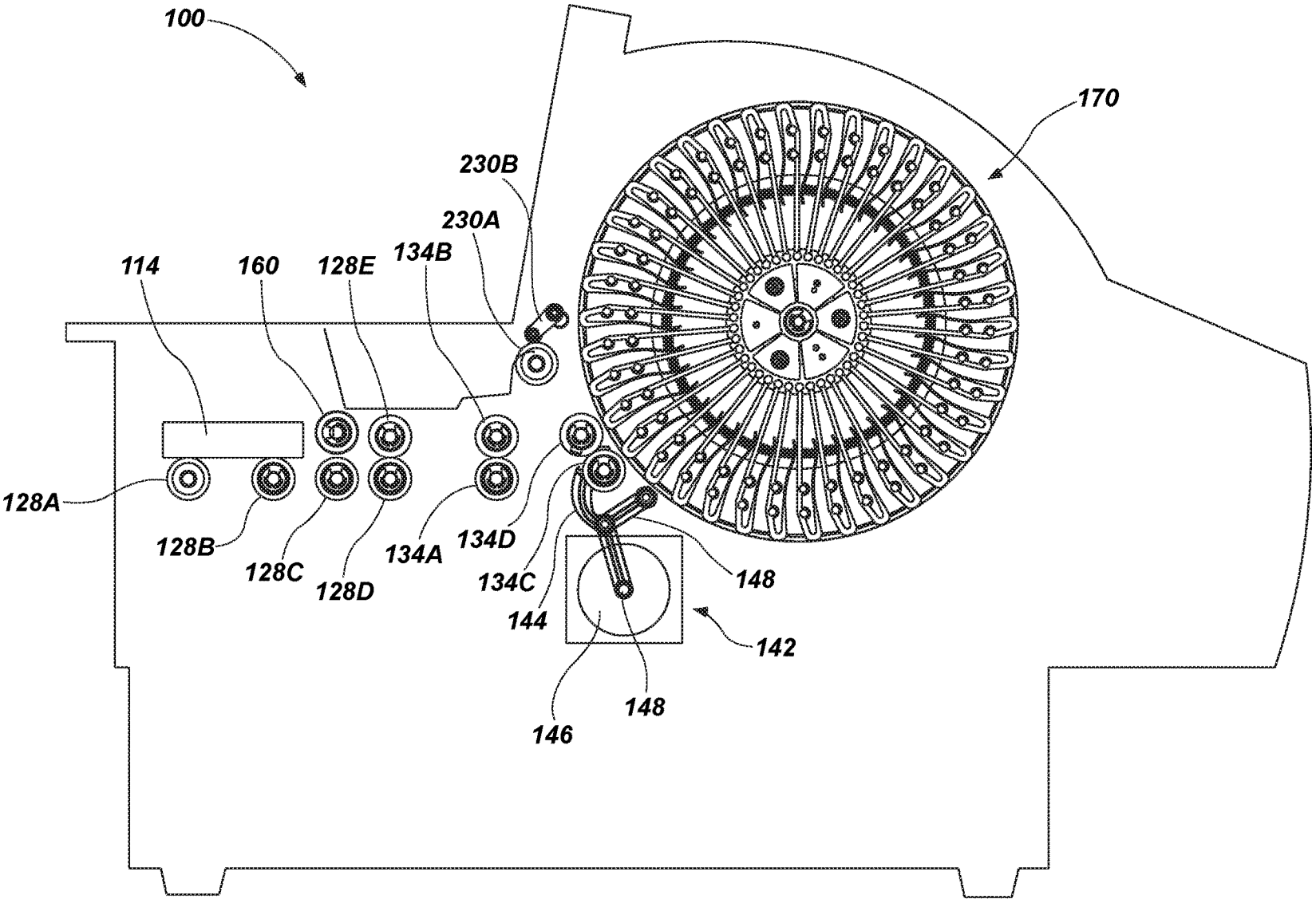
FIGS. 9A-9D are simplified and schematically illustrated cross-sectional views taken through the card shuffler of FIG. 1 along a plane parallel to the left and right sides of the card shuffler (and perpendicular to the front and back sides of the card shuffler), wherein various components and features of the card shuffler have been removed to facilitate illustration and description of operation of the card shuffler.

Referring to FIG. 5, the card input mechanism 120 further includes a packing device 142 that is used to ensure that cards inserted into the card storage device 170 are fully inserted into the card storage device 170. The packing device 142 includes a card packer 144, and a motor 146 (FIG. 3) configured to drive movement of the card packer 144 between a first extended position (see FIG. 9C) and a second retracted position (see FIG. 9A). Referring briefly to FIG. 9A, the card packer 144 may be mounted on an axle 148, about which rotation of the card packer 144 may be driven by the motor 146 (FIG. 3). Referring again to FIGS. 3 through 5, the card packer 144 may be moved to the retracted position to allow a card to pass by the card packer 144 and into the card storage device 170. After the trailing edge of the moving card has passed over the card packer 144, the card packer 144 may be moved into the extended position, which may "pack" the card into the card storage device 170 in such a manner as to ensure that the card is pushed fully into the card storage device 170 and does not bounce back out from the card storage device 170. In operation, the motor 146 of the card packer 144 of the packing device 142 rotates in a same direction until the packer arm returns to its original, retracted position.

Referring again to FIG. 1, the card input mechanism 120 may further include a card weight device 150 for applying a downward force on any stack of cards resting on the pick-off rollers 128A, 128B above card support 124. The force applied on the stack of cards may ensure that sufficient frictional force is provided between the bottommost card in the stack of cards on the card support 124 and the pick-off rollers 128A-128E to ensure that the pick-off rollers 128A-128C can reliably remove the bottommost cards sequentially one at a time from the stack until each card in the stack has been removed. The card weight device 150 may comprise a lever 151 that may be moved into an activated position in which the card weight device 150 is in direct physical contact with the upper surface of the topmost card in the stack of cards on pick-off rollers 128A, 128B above the card support 124, and applies a downward force to the cards. The lever 151 also may be moved into a deactivated position in which the lever 151 does not engage the stack of cards on the card support 124. A card weight motor 152 (see FIG. 3) and associated belt 154 may be used to drive movement of the lever 151 of the card weight device 150 between the activated position and the deactivated position. After all cards in the stack of cards on the card support 124 have been moved into the card storage device 170 by the card input mechanism 120, the card weight motor 152 may be actuated to retract the lever 151 of the card weight device 150 into the deactivated position so as to allow additional cards to be placed onto the card support 124.

Referring to FIG. 3, the card input mechanism 120 may further include at least one slide bar 164 that extends at least substantially continuously between the pick-off rollers 128A-128E and the speed-up rollers 134A-134C along the input path along which the cards move from the card input area 106 toward the card storage device 170. The slide bar 164 may have an upper surface recessed from apexes of the rollers by an average distance of about 0.07 inches or less. The slide bar 164 may be located and configured to reduce operational noise generating by cards moving along the input path responsive to operation of the card input mechanism 120. In some embodiments, the card input mechanism 120 may include two such slide bars 164 oriented at least substantially parallel to one another. In the absence of such a slide bar 164, the edges of the cards may generate a snapping noise as they move over the rollers of the pick-off rollers 128A-128E and the speed-up rollers 134A-134C. The slide bar 164 retains the cards in a substantially planar orientation during movement and may reduce the bending movement of the cards, causing the cards to slide over the top surface of the slide bar 164, and reduces the noise resulting from the snapping of the cards as they move through the card input mechanism 120.

Figure 6:
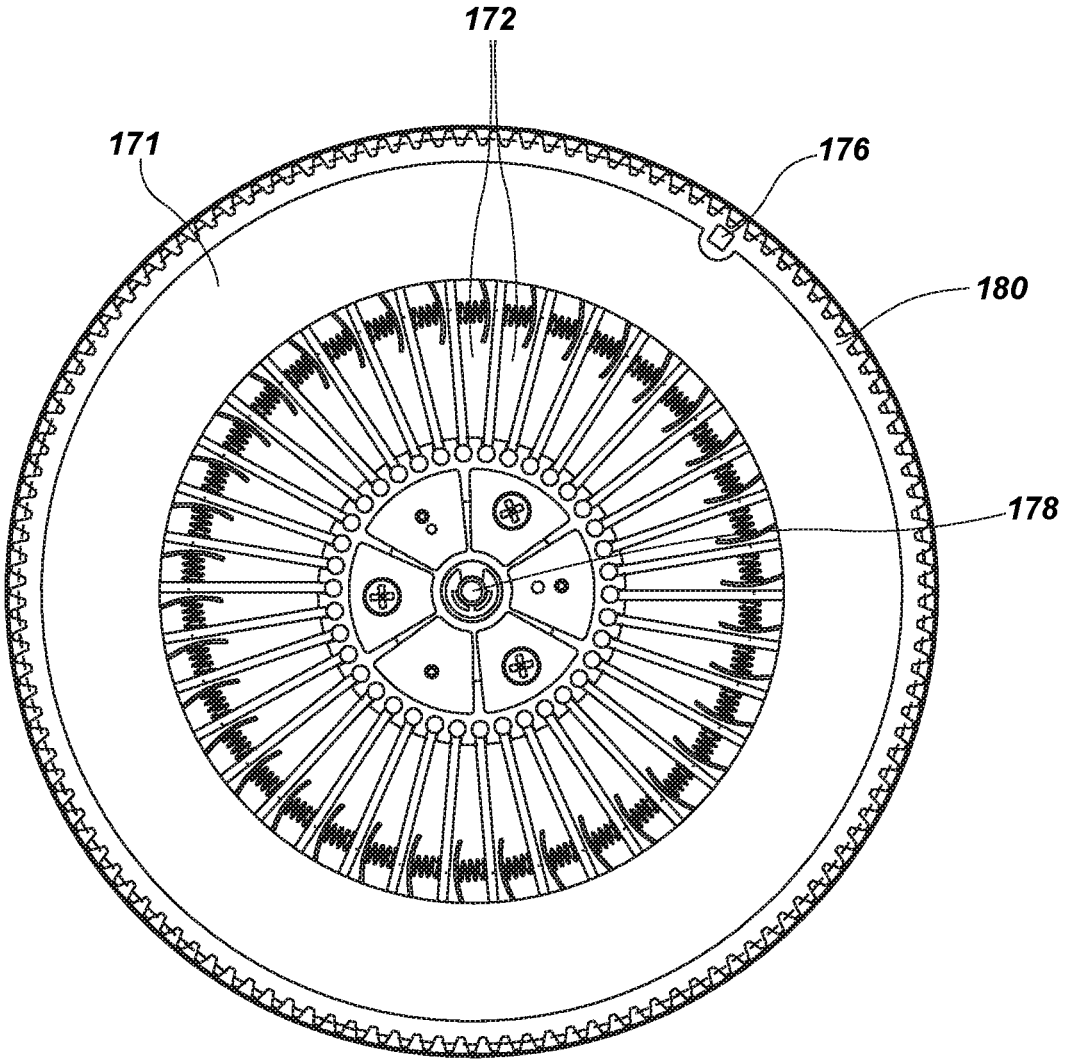
FIG. 6 is first side view of a card storage wheel of the card shuffler of FIG. 1.
Figure 7:
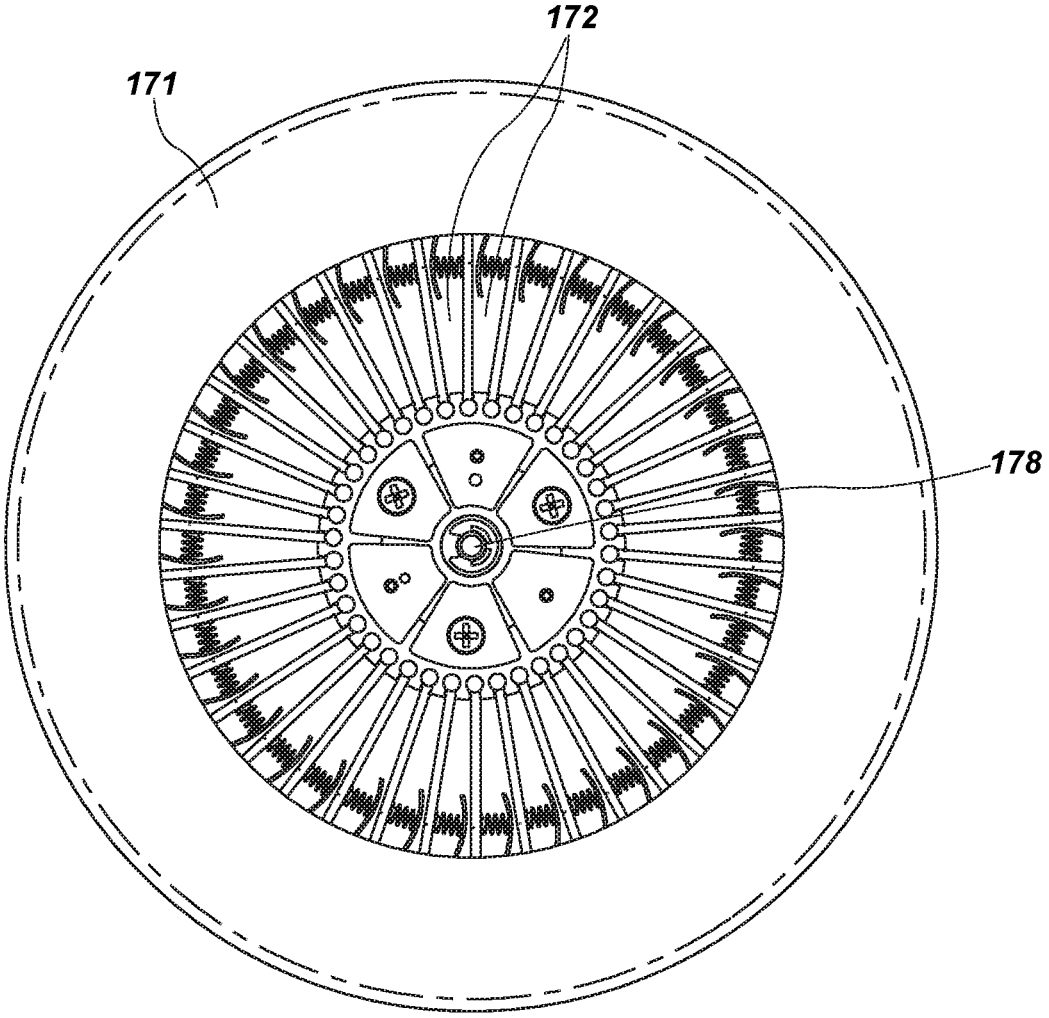
FIG. 7 is a second side view of the card storage wheel of the card shuffler of FIG. 1.

As shown in FIG. 6, the card storage device 170 includes a wheel 171 that includes a plurality of card storage compartments 172 therein. The wheel 171 is shown separate from the other components of the card shuffler 100 in FIGS. 6 and 7. Each of the card storage compartments 172 may be sized and configured to contain one or more cards therein. In some embodiments, each of the card storage compartments 172 may be sized and configured to contain approximately nine (9) or ten (10) cards therein.

The card wheel 171 is configured to rotate on an axle 178 that has an axis that is oriented such that it is parallel to the gaming table surface. As shown in FIG. 4, the card storage device 170 includes a motor 174 configured to drive rotational movement of the wheel 171 about a rotational axis extending along the axle 178. For example, the wheel 171 may include a gear 180 having cogs, and a drive shaft of the motor 174 may include a complementary gear engaged with the gear 180 of the wheel 171, such that rotation of the drive shaft of the motor 174 drives rotation of the wheel 171. In other embodiments, a belt may be used to drive rotation of the wheel 171 responsive to rotation of the drive shaft of the motor 174.

The motor 174 includes an encoder, which may be used to identify relative rotational positions of the wheel 171 from a known home position. A magnet 176 may be mounted at a known location on the wheel 171 corresponding to the known home position, and a sensor (e.g., a Hall effect sensor) may be configured to detect when the magnet 176 is adjacent the sensor, which corresponds to the known home position.

To identify and calibrate the home position in a set-up or a calibration operational mode of the card shuffler 100, the wheel 171 may be rotated until the sensor detects the presence of the magnet 176 adjacent the sensor, and the encoder associated with the motor 174 may be reset, or the value of the encoder at the home position may be recorded. The location of the wheel 171 at this point, as determined by the value of the encoder associated with the motor 174, may be set as the home position in the control system 280 (FIG. 8) of the card shuffler 100.

As best shown in FIG. 5, the card storage compartments 172 are defined by a plurality of card retention members 182, each of which has a generally planar and elongated portion 184. The elongated portions 184 extend radially outward from locations proximate the axle 178. Each card retention member 182 also includes a cantilever member 186 that is integral with the radially outer end of the elongated portion 184, and wraps around and extends in cantilevered fashion over a section of the elongated portion 184 in the radially inward direction. A coil spring 188 is positioned between the elongated portion 184 and the cantilever member 186 of each card retention member 182 so as to bias the cantilever member 186 away from the integral elongated portion 184 from which it extends. The card retention members 182 are stacked beside one another circumferentially around the wheel 171, and each card storage compartment 172 comprises the space between an elongated portion 184 of one card retention member 182 and the cantilever member 186 of the neighboring adjacent card retention member 182. As cards are inserted into the card storage compartment 172, the spring-biased cantilever member 186 holds the cards against the elongated portion 184 of the neighboring adjacent card retention member 182.

Each card retention member 182 includes a tapered surface 190 proximate the entrance to the card storage compartment 172. By aligning the card being fed with the tapered surface 190, the card may be driven into the card storage compartment 172 below any cards already present. For purposes of this disclosure, references to "above" and "below" relate to a position in the compartment when the compartment is aligned with the card output mechanism 220. By aligning the card being fed with the space between the elongated portion 184 of one card retention member 182 and the cantilever member 186 of the neighboring adjacent card retention member 182, the card may be driven into the card storage compartment 172 above any cards already present. When the device is used to place cards in a pre-selected order, such as original deck order, the tapered surfaces 190 may be used to achieve a desired order by providing cards at predetermined known positions within the card storage compartments 172 in which they are disposed. It is desirable in some embodiments to use a wheel with enough compartments so that the set of cards being ordered can be distributed, two cards per compartment. Since the device is capable of inserting a second card above or below a first inserted card, the desired order of cards can be achieved when the cards from each compartment are recombined to form one ordered group.

When a random order is desired, the tapered surfaces 190 may also be used to achieve a desired random distribution. For example, the processor may select a location for each card to be fed at the beginning of a shuffling cycle. Each card storage compartment 172 may be designated with two locations, an upper first location and a lower second location. If a first card was assigned to the first location, the second card would be driven into the card storage compartment 172 either below the first card in the first location or above the second card in a second location using a tapered surface.

As discussed in further detail below, the card shuffler 100 may be configured to selectively position the wheel 171 at either of two different positions for each of the card storage compartments 172 in the wheel 171 during card distribution. In particular, the card shuffler 100 may be configured to selectively position the wheel 171 such that a card being inserted into a selected card storage compartment 172 by the speed-up rollers 134A-134D is inserted above or below any cards already present in the respective card storage compartment 172.

Referring again to FIGS. 3 through 5, the card shuffler 100 includes a card output mechanism 220 for moving cards within the wheel 171 of the card storage device 170 out from the wheel 171 and to the card output area 108. As shown in FIGS. 3 and 4, the card output mechanism 220 includes a pair of ejector arms 222 that are used to eject all cards within a selected card storage compartment 172 in the wheel 171 out from the respective card storage compartment 172 of the wheel 171, simultaneously and together as a group, and into one or more pairs of card output rollers 230.

Each of the ejector arms 222 may comprise an elongated and vertically oriented bar or rod. The ejector arms 222 may be structurally connected to each other by a cross bar extending between the ejector arms 222 at a location below the card storage device 170. The ejector arms 222 may be pivotally mounted to the frame 102 at lower ends thereof by pins 223. The ejector arms 222 may be configured to pivot back and forth about the pins 223 between a first retracted position and a second extended position. The card output mechanism 220 further includes an ejector motor 225 and an associated ejector belt 227 (FIG. 4) configured to selectively drive movement of the ejector arms 222 between the first retracted position and the second extended position. As shown in FIG. 4, one of the ejector arms 222 may be fixedly attached to the ejector belt 227 by a clamp 228. In this configuration, rotation of the ejector motor 225 causes rotation of the ejector belt 227, which drives pivotal movement of the ejector arms 222 about the pins 223.

As previously mentioned, the wheel 171 includes card storage compartments 172 defined by card retention members 182. The wheel 171 and the ejector arms 222 may be sized and configured to allow the ejector arms 222 to move alongside the wheel 171 from the first retracted position of the ejector arms 222 to the second extended position of the ejector arms 222, which will cause the ejector arms 222 to eject any and all cards in the respective card storage compartment 172 with which ejector levers (not shown) are aligned to be simultaneously ejected out from the wheel 171 and into card output rollers 230. In embodiments, the wheel 171 has 38 compartments, which exceeds the number that is sufficient to provide one compartment for each two cards in a typical 52-card deck with up to two jokers added, plus one cut card. In this example, a total of 27 compartments would be needed to resort this group of cards back into deck order. The number of compartments may be varied to accommodate different deck sizes. For example, if a game requires two intermixed decks, no jokers and no security card, and a total of 104 cards formed the set of cards to be randomized, and it was necessary to arrange the set of cards into deck order, it would be desirable to increase the number of compartments to 52.

The card output mechanism 220 may be configured to eject cards out from the card storage compartments 172 of the wheel 171 and into a card output compartment in the card output area 108 such that the cards are oriented relative to the horizontal plane at a downward angle of between 2° and about 15°, or even between about 2° and about 5°, at all times as the cards move from each card storage compartment 172 and into the card output compartment in the card output area 108. By ensuring that the cards are oriented at a downward angle at all times as the cards move from each card storage compartment 172 and into the card output compartment in the card output area 108 may ensure that players are not able to view or identify the cards as they move into the card output compartment. The cards may rest on a card support surface 110 (FIG. 1) in the card output compartment of the card output area 108, and the card support surface 110 may also be oriented relative to the horizontal plane at a downward angle of between 2° and about 15°, or even between about 2° and about 5°. As a result, the card output compartment may be configured such that cards held therein are oriented at a downward angle of between 2° and about 15°, or even between about 2° and about 5°.

With continued reference to FIGS. 3-5, the card shuffler 100 optionally may include a card reading and/or imaging system 250 configured to capture data representing at least rank and suit information included in one or more images of each card passing through the card shuffler 100, so as to allow the card shuffler 100 to identify one or more characteristics of the cards, such as the rank and/or suit of standard playing cards. In some embodiments, however, data pertaining to cards read using the card reading system 250 may not be used in the shuffling operations performed by the card shuffler 100 for the purpose of determining the random card order, although the data may be used in the shuffling operations for the purpose of card verification. The data pertaining to card data read using the card reading system 250 may be used to verify the completeness of a set of cards by ensuring that no card expected to be in the set of cards is missing from the set of cards (e.g., a missing card in a single deck of standard playing cards), and/or that cards not expected to be present in the set of cards are not present in the set of cards (e.g., a duplicate or extra card in a single deck of standard playing cards).

As shown in FIG. 5, the card imaging system 250 may include an image sensor 252 for capturing images of cards. The term "image" as used herein means at least one of suit and rank indicia on a card and does not necessarily mean a full image of any card. The image sensor 252 may be located and configured, for example, to capture images of cards as the cards pass through the card input mechanism 120 between the pick-off rollers 128A-128E and the speed-up rollers 134A-134D. In other embodiments, the card image sensor 252 may be located in the card input area 106 beneath the card support 124 (FIG. 1). In some embodiments, the card imaging system 250 may comprise a camera device that includes a complementary metal-oxide-semiconductor (CMOS) image sensor or a charge coupled device (CCD) image sensor. For example, the card sensing system may include a video camera imaging system as described in U.S. Pat. No. 7,677,565, which issued Mar. 16, 2010 to Grauzer et al., the disclosure of which is incorporated herein in its entirety by this reference.

Figure 8:
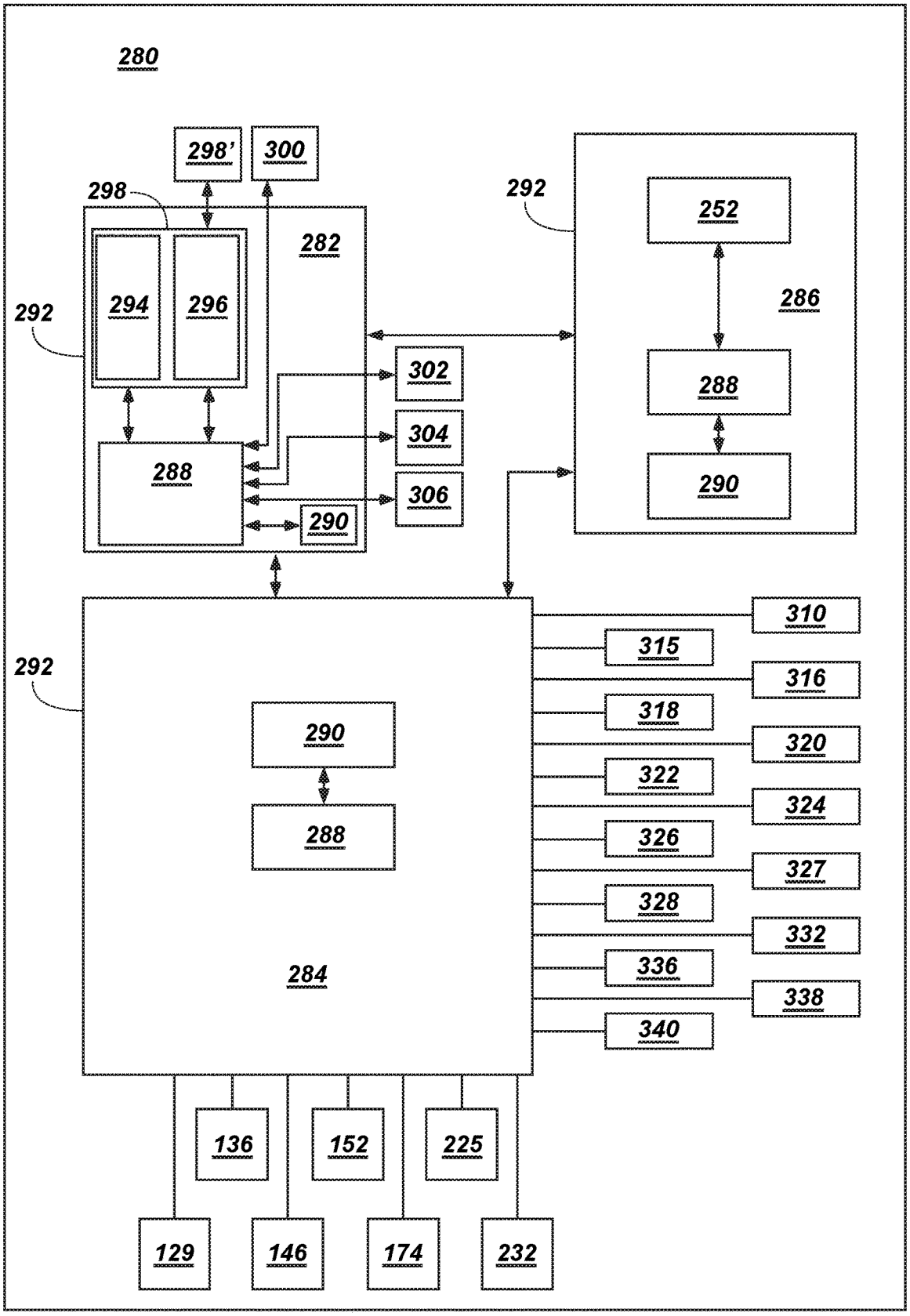
FIG. 8 is a block diagram illustrating various components of a control system of the card shuffler of FIG. 1.

Referring to FIG. 8, the card shuffler 100 may comprise a control system 280 for controlling operation of the various active components of the card shuffler 100, for receiving data input from a user of the card shuffler 100, and for outputting data and/or information to a user of the card shuffler 100. FIG. 8 illustrates a non-limiting example embodiment of a control system 280 that may be used for controlling the card shuffler 100. The control system 280 may include one or more control modules for performing different functions of the control system 280, which control modules may be operatively coupled together. For example, the control system 280 may include a main control module 282, a motor/sensor control module 284, and an imaging control module 286.

The main control module 282 may include one or more computer programs stored electronically in a memory device or devices 290 thereof, which computer programs may be configured to control operation of the various active components of the card shuffler 100.

As shown in FIG. 8, the main control module 282 may be configured to communicate electrically with (i.e., send electronic signals to, and/or receive electronic signals from) each of the motor/sensor control module 284 and the imaging control module 286. The communication between modules 282, 284, and 286 may be either direct or indirect. For example, one or more wires or other electrical communication pathways may extend between the main control module 282 and each of the motor/sensor control module 284 and the imaging control module 286. In some embodiments, the imaging control module 286 may be configured to communicate electrically with the motor/sensor control module 284, either indirectly through the main control module 282 or directly by way of one or more wires or other electrical communication pathways that extend directly between the imaging control module 286 and the motor/sensor control module 284.

Each of the main control module 282, the motor/sensor control module 284, and the imaging control module 286 may include one or more electronic signal processors 288 for processing electronic signals, and one or more memory devices 290 (e.g., random access memory (RAM), read-only memory (ROM), Flash memory, etc.) for storing electronic data therein. Each of the main control module 282, the motor/sensor control module 284, and the imaging control module 286 may comprise a printed circuit board 292, to which the electronic signal processors 288 and memory devices 290 may be respectively coupled.

The main control module 282, the motor/sensor control module 284, and the imaging control module 286 may be mounted within the card shuffler 100. In some embodiments, the main control module 282, the motor/sensor control module 284, and the imaging control module 286 may be mounted at separate locations within the card shuffler 100. In some embodiments, the image sensor 252 of the card imaging system 250 may be mounted directly to a printed circuit board 292 of the imaging control module 286, and the imaging control module 286 may be mounted within the card shuffler 100 at a location at which the image sensor 252, while mounted to the printed circuit board 292, may capture images of cards as the cards pass through the card input mechanism 120 between the pick-off rollers 128A-128C and the speed-up rollers 134A-134D, as previously described.

With continued reference to FIG. 8, the main control module 282 may include a data input device 294 configured to allow a user to input data into the control system 280, and a data output device 296 configured to display information to a user. In some embodiments, the data input device 294 and the data output device 296 may comprise a single, unitary device, such as a touch-screen control panel 298 (see also FIG. 1) that can be used both to display information to a user, and to receive input from a user. In some embodiments, the control system 280 may include a first primary control panel 298, and a second control panel 298', which may be used primarily for setup and/or maintenance of the card shuffler 100. Control panel 298' may be internal to the machine, external to the machine or may be a separate device in communication with the control panel 298. The first and second control panels 298, 298' each may comprise touch-screen displays, which may be operatively coupled with the main control module 282. In some embodiments, the first and second control panels 298, 298' may be mirrored with one another, such that what is displayed on one is exactly the same as what is displayed on the other, and such that the card shuffler 100 may be controlled by inputting data into either of the control panels 298, 298'. In other embodiments, the control panel 298 may comprise a primary host control panel, and the control panel 298' may comprise a secondary control panel. In such embodiments, depending on a selectable operational mode of the card shuffler 100, either the primary host control panel 298 or the secondary control panel 298' may be used. When the secondary control panel 298' is being used, the user interface to be displayed on the secondary control panel 298' may be forwarded to the secondary control panel 298' from the primary host control panel 298. When the secondary control panel 298' is being used, the first control panel 298 may display a message indicating that the secondary control panel 298' is being used. Input received from the secondary control panel 298' may be forwarded to the primary host control panel 298.

The secondary control panel 298' may not be visible or otherwise accessible to a user of the card shuffler 100 during normal operation, and the first control panel 298 may be located such that the first control panel 298 is visible and accessible to a user of the card shuffler 100 during normal operation of the card shuffler 100.

In some embodiments, the second control panel 298' may comprise a modular display unit that may be mounted to a surface of a gaming table at a location separate from the main console of the card shuffler 100 (shown in FIGS. 3-5), which comprises the card input mechanism 120, the card storage device 170, and the card output mechanism 220, and may be operatively coupled with the main control module 282 of the control system 280 using a wired or wireless connection.

The first control panel 298 may be mounted directly to the printed circuit board 292 of the main control module 282 in some embodiments. The first control panel 298 may be adapted and used for installation, initial set-up, and maintenance of the card shuffler 100, while the second control panel 298' may be adapted and used for controlling operation of the card shuffler 100 during normal use of the card shuffler 100 for shuffling, sorting, and verification of cards.

In other embodiments, however, the card shuffler 100 may include a single data input device 294 and a single data output device 296, such as a single control panel 298 comprising a touch-screen display, which may be located anywhere on the card shuffler 100 (e.g., on the inside or the outside of the card shuffler 100) or remote from the card shuffler 100.

The control system 280 may also include a player display 300 (see also FIG. 1) mounted to the automatic card shuffler 100, and the control system 280 may be configured to display information to players of a playing card game in which the automatic card shuffler 100 is used on the player display. For example, the control system 280 may be configured to display information to players of a playing card game in which the automatic card shuffler 100 is used on the player display 300 relating to at least one of: the game name; the game logo; game trade dress such as graphical indications of a theme; branded thematic content such as licensed trademarks and personas, minimum or maximum bet quantities, a winning playing card hand composition, an indication of a winning hand; a celebration video drawing attention to a player winning hand; a recommended player card hand, game advice; game rules; a game pay table; other game play information, a casino identity; promotional information such as incentives and player offers; a virtual card that may be used in a playing card game in conjunction with the actual physical playing cards, a mystery bonus outcome; a dealer identity, video feed for entertainment purposes; a how to play video to teach players how to play the game; casino graphics, graphs or tables of information, such as historical game play results, identification of a game being played in conjunction with the automatic card shuffler 100, etc. As shown in FIG. 1, the touch screen control panel 298 may be oriented for viewing from a first side of the automatic card shuffler 100, and the player display 300 may be oriented for viewing from an opposing second side of the automatic card shuffler 100.

As shown in FIG. 8, the card shuffler 100 may also include a printer 302 operationally coupled with the control system 280. The control system 280 may be configured under control of a program to print information onto a printable medium, such as paper, using the printer 302. In some embodiments, the printer 302 may be integral with the main body of the card shuffler 100. In other embodiments, the printer 302 may comprise a separate printer module operably coupled with the main body of the card shuffler 100 using a wired or wireless connection. The information printed by the printer 302 onto the printable medium may comprise, for example, information usable in verifying a winning playing card hand generated by the card shuffler 100 in a round of game play. The printer may be used to create a physical record of a wide variety of information, including but not limited to: a winning hand verification, a verification that a complete set of cards was sorted into a predetermined order such as pack order, a confirmation that the set of cards is complete, the presence of a security card or other special in the sorting wheel, a player identity acquired from a player input into a player loyalty system, a jackpot amount won, the time of day, the date, the dealer identity from a table game management system, legal notices, such as the need to complete IRS forms upon winning a jackpot, the winning hand composition, a table identification, a shift manager, the identity of pit personnel, the name of the game, the specific jackpot won, and the like. This information can be printed individually or in combination on a paper receipt. The receipt can be given to the player or may be retained by pit personal for internal use. The printer may also be used to indicate that a deck of cards is to be decommissioned, to indicate the start and end time of shuffling of that particular deck of cards, and may provide an indication that the deck should be retired because the usage criteria set by the house has been met. For example, the house may require the dealer to retire the deck at the conclusion of each shift. An indication of a shift being over may be printed out, providing a visual indication that the deck has met the criteria for retirement.

For example, the information printed by the printer 302 may include the identities of all cards in a winning playing card hand generated by the automatic card shuffler 100 in a round of game play, the name of the player, the time, date, table identification number and the jackpot amount. Thus, in round of game play, if a player is dealt a winning card hand, or a playing card hand that entitles the player to a monetary award, such as a progressive payout or a bonus award for being dealt a playing card hand having a specific, predefined composition, the printer may create a physical record of the event. The printed medium with the identifying information thereon may be used to verify the playing card hand, and may be used to confirm a prize prior to redemption of the award by the player to which the winning hand was dealt.

The motor/sensor control module 284 may be configured to control operation of the various motors within the card shuffler 100, and to receive signals from various sensors within the card shuffler 100. The various sensors of the card shuffler 100 may be used by the control system 280 to identify current operational states of the various active components of the card shuffler 100, such as locations of the movable components of the card shuffler 100.

For example, each of the motor 129 for the pick-off rollers 128A-128C, the motor 136 for the speed-up rollers 134A-134D, the motor 146 for the card packer 144, the card weight motor 152 for the card weight device 150, the motor 174 for the wheel 171, the ejector motor 225 for the ejector arms 222, and the card output motor 232 for the card output rollers 230A, 230B may be electrically coupled with the motor/sensor control module 284 to allow the motor/sensor control module 284 to independently, selectively activate and deactivate the motors as needed to control operation of the card shuffler 100.

Figure 11:
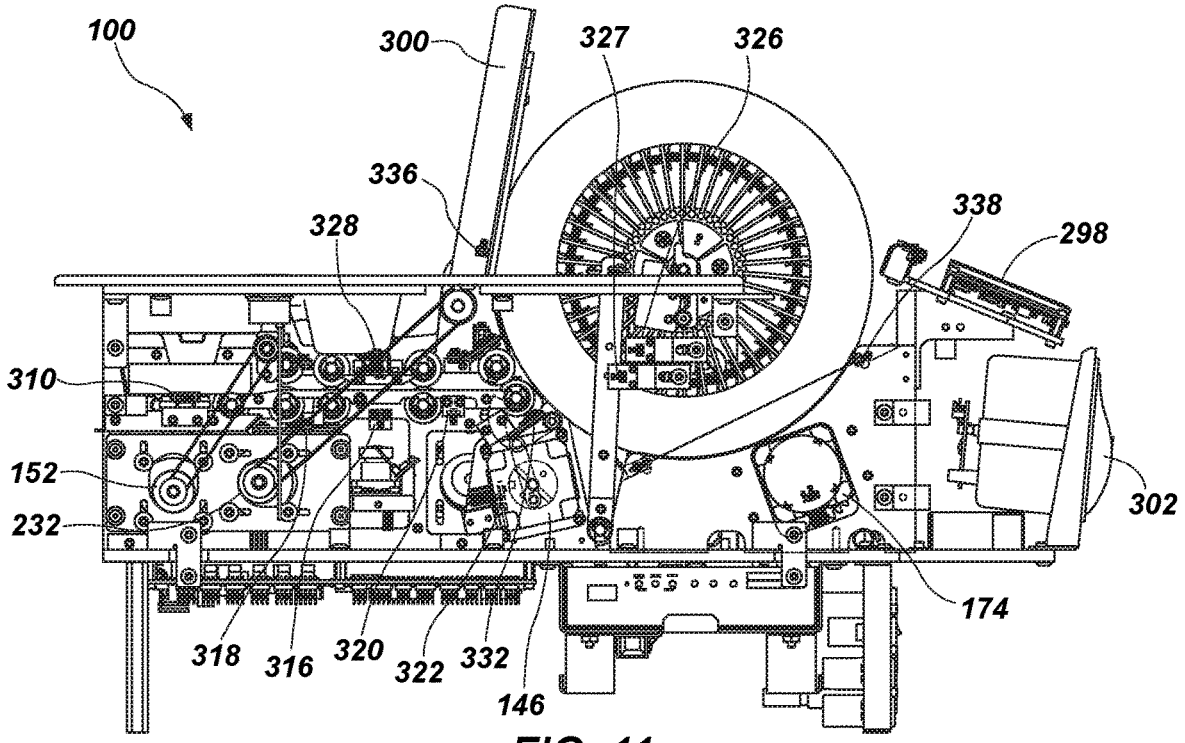
FIG. 11 is a first side view of the card shuffler similar to FIG. 3, but all portions of the outer cover have been removed to illustrate locations of motors and sensors within the card shuffler.
Figure 12:
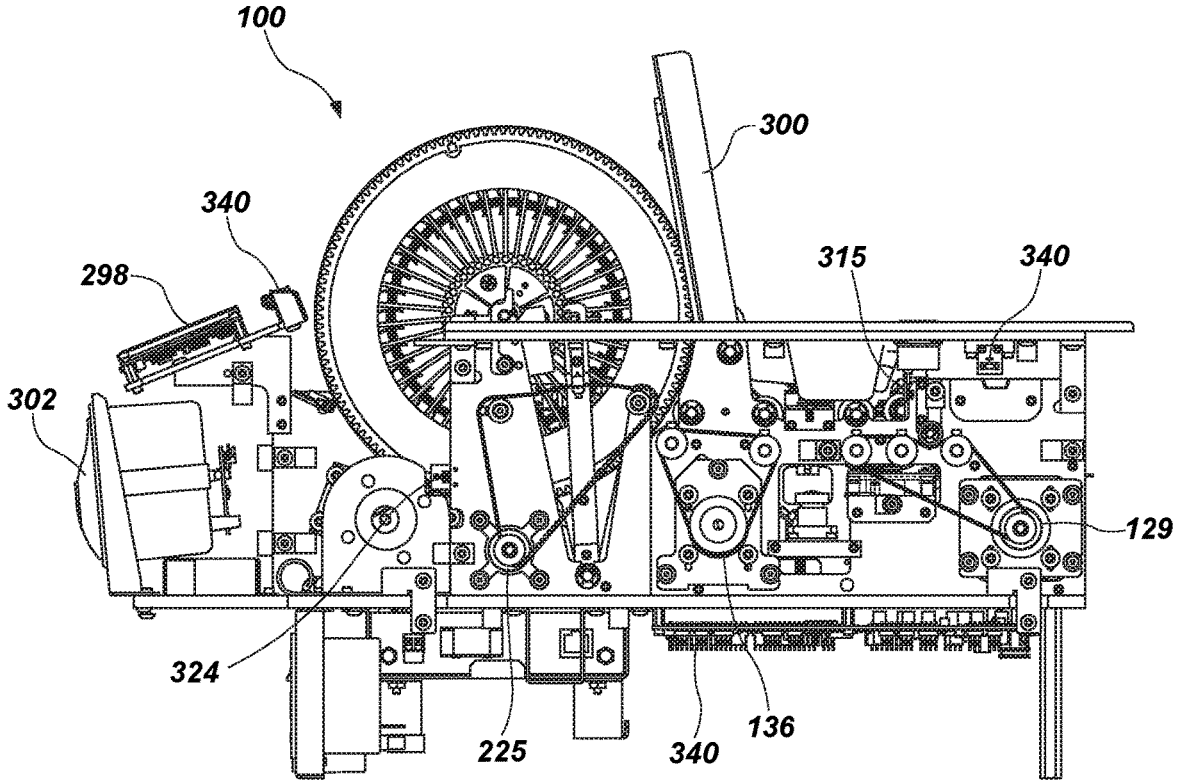
FIG. 12 is a second side view of the card shuffler similar to FIG. 4, but all portions of the outer cover have been removed to illustrate locations of motors and sensors within the card shuffler.

The card shuffler 100 may include a number of sensors, which also may be operatively coupled with the motor/sensor control module 284. The various motors and sensors are identified in the block diagram of the control system in FIG. 8, and locations of the motors and sensors are identified in the right and left side view of the card shuffler 100 in FIGS. 11 and 12, in which all portions of the cover 104 have been removed for purposes of illustration.

By way of example and not limitation, the card shuffler 100 may include a feeder card present sensor 310 configured to detect the presence of one or more cards on the card support 124 of the card input mechanism 120. A card weight sensor 315 may be located and configured to detect whether the card weight lever 151 of the card weight device 150 is in the activated and/or deactivated position. A feeder card out sensor 318 may be located and configured to detect when a card moving responsive to actuation of the pick-off rollers 128A-128E approaches the speed-up rollers 134A-134D. A camera trigger sensor 316 may be located and configured for use in triggering activation of the image sensor 252 of the card imaging system 250 to acquire one or more images of the card. Optionally, the camera trigger sensor 316 may be used by the motor/sensor control module 284 to momentarily deactivate movement of the pick-off rollers 128A-128E while the image sensor 252 of the card imaging system 250 acquires one or more images of the card, after which the motor/sensor control module 284 may reactivate movement of the pick-off rollers 128A-128E to cause the card to be engaged by the speed-up rollers 134A-134D and inserted into the card storage device 170.

A pick-off stop sensor 320 may be located and configured to detect when a card is moving responsive to activation of the speed-up rollers 134A-134D, and may be used to stop rotation of the pick-off rollers 128A-128E. A card in/out sensor 332 may be located and configured to detect the presence of cards moving into or out from the card storage device 170 by the card input mechanism 120. The card in/out sensor 332 may be capable of detecting the presence of a card proximate the card in/out sensor 332, and capable of detecting whether the card is moving into the card storage device 170 or out from the card storage device 170. The speed-up rollers 134A-134D may be capable of pushing a card toward and into the card storage device 170, and capable of pulling a card back away from the card storage device 170. For example, in the case of a card jam wherein a card being inserted into the card storage device 170 is not actually inserted into the card storage device 170 as intended, the direction of rotation of the speed-up rollers 134A-134D may be reversed to withdraw the card from the card storage device 170, after which the position of the card storage device 170 may be adjusted and the speed-up rollers 134A-134D activated to again attempt to insert the card into the card storage device 170. If the card cannot be inserted into the card storage device 170 upon a predetermined number of attempts, operation of the card shuffler 100 may be interrupted and an error message provided to a user via the data output device 296 of the control system 280.

The card shuffler 100 may further include one or more packer sensors 322 located and configured to sense a position of the card packer 144. For example, a packer sensor 322 may be located and configured to sense when the card packer 144 is in the retracted position. One or more wheel home sensors 324 may be located and configured to sense a position of the wheel 171. For example, a wheel home sensor 324 may be located and configured to sense when the wheel 171 is in a designated "home" rotational position. The card shuffler 100 may further include one or more ejector sensors 326, 327. For example, the card shuffler 100 may include an ejector home sensor 326 located and configured to sense when the ejector arms 222 are disposed in a home position in which the wheel 171 may be removed from the card shuffler 100 for maintenance or repair without interference with the ejector arms 222, and an ejector working sensor 327 may be located and configured to sense when the ejector arms 222 are disposed in the working retracted position during operation of the card shuffler 100.

A wheel card out sensor 336 may be located and configured to detect the presence of cards being ejected out from the wheel 171 by the card output mechanism 220. A wheel card present sensor 338 may be located and configured for use in detecting whether or not any cards are present in the card storage compartments 172 of the wheel 171.

The card shuffler 100 may include a platform card present sensor 328 located and configured to detect the presence of one or more cards in the card output area 108.

Some of the sensors may comprise reflective or pass-through type photoactive sensors that include an emitter for emitting radiation and one or more receivers for receiving radiation emitted by the emitter. In some embodiments, one or more of the photoactive sensors may include two radiation receivers oriented at different locations along the direction of movement of the cards, such that the photoactive sensor may determine a direction of movement of any card moving proximate the sensor by detecting which of the two radiation receivers receives radiation first as a card moves past the sensor.

The card shuffler 100 may also include one or more cover present sensors 340 located and configured to detect whether or not the cover 104 or the components of the cover 104 are in place on the card shuffler 100 so as to prevent operation in the event the cover 104 is not in place on the card shuffler 100.

Referring again to FIG. 3, the card shuffler 100 may include a drip pan 350 located and configured to divert fluid spilled into at least one of a card input receptacle of the card input area 106, and a card output receptacle of the card output area 108 to an exterior of the automatic card shuffler 100. For example, the drip pan 350 may be located vertically below at least one of the card input receptacle and the card output receptacle. At least one outer cover 104 of the card shuffler 100 may include at least one aperture 352 extending therethrough. The aperture 352 may be located and configured to allow spilled fluid diverted by the drip pan 350 to pass out from the automatic card shuffler 100 through the aperture 352 in the outer cover 104. As shown in FIG. 1, the drip pan 350 may extend at least partially through the aperture 352 extending through the outer cover 104. As best seen in FIG. 3, the drip pan 350 may have a generally planar base member oriented generally horizontally within the automatic card shuffler 100, and one or more lateral sidewalls extending vertically from the base member so as to laterally confine fluid spilled on the generally planar base member and hinder or prevent the spilled fluid from spilling onto other active, internal components of the card shuffler 100.

Referring again to FIG. 8, in some embodiments, the card shuffler 100 may include at least one light-generating device 304 located within the automatic card shuffler 100 and configured to generate light within the card shuffler 100. The light generated by the light-generating device 304 may not be used by any sensor of the card shuffler 100 (such as, for example, the image sensor 252). The light generated may be used to hinder or prevent any unauthorized foreign device, such as a camera or other image-capturing device, from acquiring images of cards from within the card shuffler 100. For example, the light may be used to saturate or white-out any image acquired by such an unauthorized foreign device. Thus, the light-generating device 304 may be located and configured to interfere with any imaging device located within the card shuffler 100, and not by the card shuffler 100 for operation thereof. The light-generating device 304 may comprise, for example, a strobe light configured to intermittently generate flashes of light within the card shuffler 100. The light-generating device 304 may comprise, for example, one or more light-emitting diodes (LEDs) or any other type of light-emitting device. In other examples, the light-generating device 304 may serve as the light source for the imaging system. In other examples, the light-generating device 304 may be provided in addition to the light source for the imaging system.

The card shuffler 100 may be used to shuffle cards and form randomized playing card hands, to sort cards, and/or to verify cards or sets of cards. For example, the card shuffler 100 may be used to perform a shuffling operation on a stack of cards and form and deal randomized playing cards hands, as described below with reference to FIGS. 9A through 9D and FIG. 10. The card shuffler 100 may be placed in a shuffling mode using the data input device 294 of the control system 280 (FIG. 8).

Figure 10:
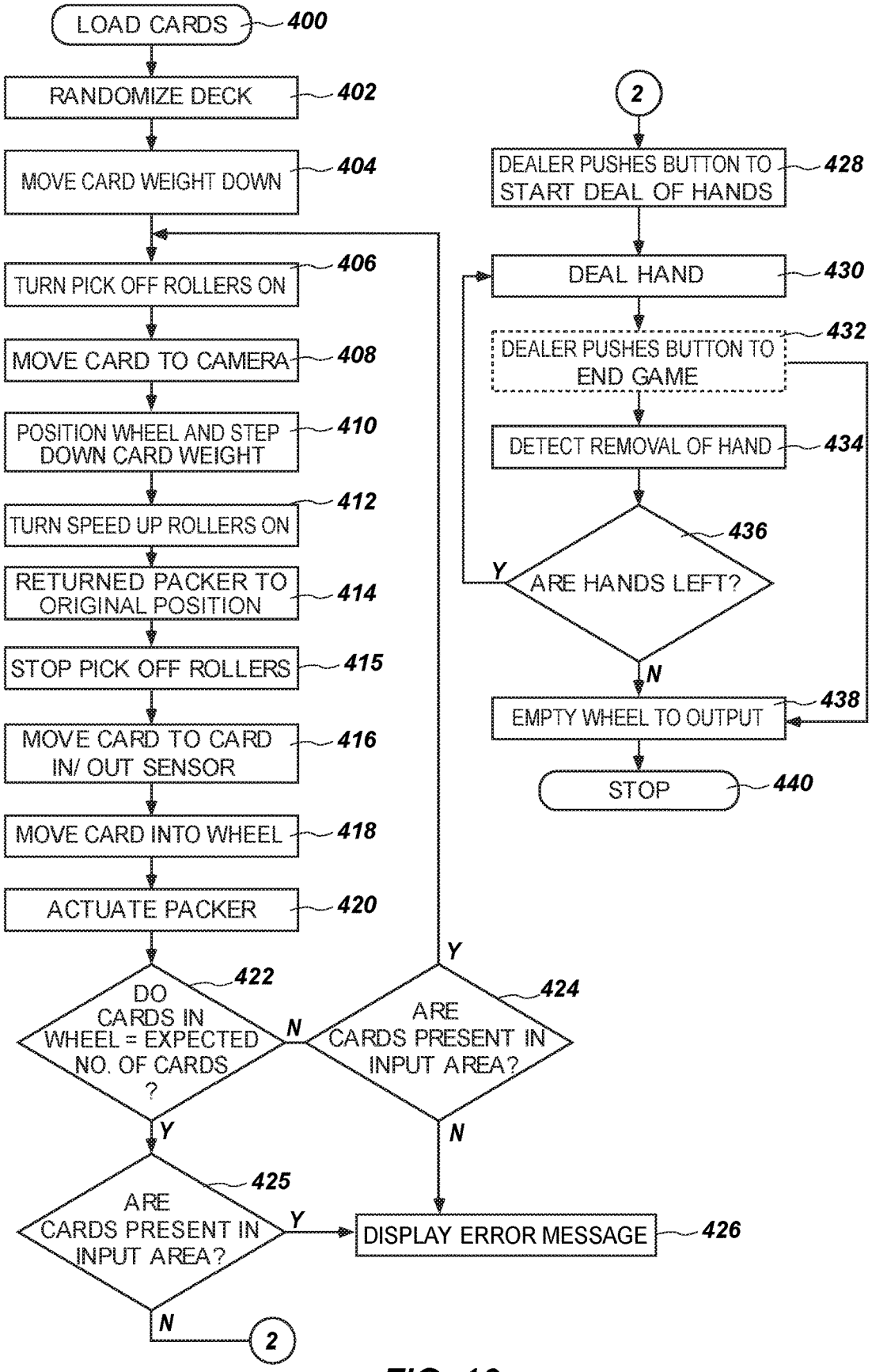
FIG. 10 is a flowchart illustrating operation of the card shuffler during a shuffling operation.

Referring to FIG. 9A, a stack of cards 114 may be loaded into the card input area 106 by a user, such that the cards rest on the card support 124, as represented in action 400 in FIG. 10. The card input area 106 may support a set of cars to be shuffled. The control system 280 (FIG. 8) may be configured such that, upon detecting the presence of cards 114 on the card support 124 in the card input area 106 using the feeder card present sensor 310 and the absence of cards in the card output area 108 using the platform card present sensor 328 for a predetermined amount of time (e.g., three seconds), the control system 280 may automatically commence a shuffling operation as represented as action 402 in FIG. 10.

As previously mentioned, the card shuffler 100 may be configured for use in shuffling and forming randomized sets of playing cards, such as hands, partial hands, common card sets, etc., from a single fifty-two (52) card deck of standard playing cards, which may optionally include one or two additional cards, such as Jokers, for a total of fifty-four (54) cards to be shuffled. The wheel 171 may include as many as thirty-eight (38) card storage compartments 172 or more (FIGS. 5 through 7), each of which may be sized and configured to hold as many as nine (9) or ten (10) cards therein at any given time. Thus, the wheel 171 may be capable of holding as many as approximately three hundred and eighty (380) cards therein at a given time, and may be capable of forming any number of randomized sets of playing cards up to the number of card storage compartments 172 within the wheel 171. In practice, however, the card shuffler 100 may typically be used in games in which from two (2) to twelve (12) randomized playing card hands may be formed and dealt in a round of a playing card game. When the game is a specialty table game, the number of player positions is typically between 5 and 7 and the dealer may also receive a hand or partial of cards. Each playing card hand may be formed within a respective one of the card storage compartments 172. For example, in a playing card game in which six (6) hands are to be formed and dealt in each round of the playing card game, the control system 280 may designate six (6) adjacent card storage compartments 172 for holding the six (6) playing card hands therein respectively. In other embodiments, six compartments that are not adjacent are selected for forming the hands. A remaining number of the card storage compartments 172 may be designated for holding any remaining cards in the shuffled cards that are not used in forming the playing card hands. One advantage of selecting adjacent hand-forming compartments is that the selection speeds up the process of card distribution, because it reduces wheel travel distance during card distribution.

To shuffle cards or "randomize" the deck, as indicated at action 402 in FIG. 10, the control system 280 of the card shuffler 100 creates a card position table that randomly assigns and correlates the cards in the stack to be shuffled to one of the card storage compartments 172 in the wheel 171. If, for example, the playing card game being played requires the formation of six (6) complete playing card hands, and each playing card hand is to include three (3) playing cards, the control system 280 will randomly designate three (3) cards for storage in each of the designated card storage compartments 172 in the wheel 171 in which the six (6) playing card hands are to be respectively formed.

The control system 280 sequentially numbers the cards from the bottom card in the stack of cards 114 toward the top of the stack of cards 114 by sequentially assigning an integer to each card. The control system 280 also sequentially numbers the card storage compartments 172 in the wheel 171. For example, the card storage compartment 172 in the wheel 171 that is aligned with the card input mechanism 120 when the wheel 171 is in the home position may be designated as card storage compartment "1." The card storage compartments 172 are then assigned sequentially increasing integers (e.g., 2, 3, 4, etc.) moving circumferentially around the wheel 171.

Thus, the control system 280 may randomly assign and correlate cards in the stack of cards 114 resting on the card support 124 in the card input area 106 to card storage compartments 172 in the wheel 171. For example, the control system 280 may include a random number generator, which may be used to randomly assign and correlate cards in the stack of cards 114 resting to the card storage compartments 172 in the wheel 171, but designating the number of cards in each playing card hand to be formed for insertion into each of the designated card storage compartments 172 in which playing card hands are to be formed (e.g., card storage compartments "1" through "6"). Since a standard deck of playing cards may include approximately fifty-two (52) to fifty-four (54) playing cards, and each of the card storage compartments 172 may hold as many as ten (10)

cards, less than all of the card storage compartments 172 may be employed by the control system 280 in a shuffling mode. For example, if six (6) playing card hands are to be formed in each round of game play using a standard playing card deck, and each playing card hand is to include three (3) cards, eighteen (18) cards may be used in forming the playing card hands, and the remaining thirty-four (34) to thirty-six (36) are not used in the round of game play. Thus, six (6) card storage compartments 172 may be designated for forming playing card hands therein, and four (4) card storage compartments may be designated for holding the remaining playing cards therein that are not used in the round of game play. In this example, only ten (10) card storage compartments 172 are used by the control system 280 during use of the card shuffler 100 in shuffling and forming randomized playing card hands during game play. For example, card storage compartments "1" through "6" may be used for forming playing card hands therein, and card storage compartments "7" through "10" may be used for storing the remaining playing cards therein that are not used in the round of game play.

The control system 280 may generate a Card Position Table, such as Table 1 below, which includes the randomly assigned card storage compartments 172 for each sequential card in the stack of cards 114 on the card support 124 in the card input area 106. The Card Position Table may be stored in a memory device 290 of the control system 280 (FIG. 8).

TABLE 1

Card Position Table

| Card | Position |
|---|---|
| 0 | 8 |
| 1 | 10 |
| 2 | 2 |
| 3 | 8 |
| 4 | 7 |
| 5 | 1 |
| 6 | 9 |
| 7 | 9 |
| 8 | 3 |
| 9 | 10 |
| . | . |
| . | . |
| . | . |
| 48 | 4 |
| 49 | 10 |
| 50 | 5 |
| 51 | 8 |
| 52 | 9 |
| 53 | 2 |

After forming randomized playing card hands by randomly assigning cards from the stack of cards 114 on the card support 124 to the card storage compartments 172 in which the playing card hands are to be formed, the card shuffler 100 may move the card weight lever 151 of the card weight device 150 down onto the stack of cards 114 to apply a downward force on the stack of cards 114, as indicated at action 404 in FIG. 10. The card shuffler 100 then may employ the card input mechanism 120 to sequentially move the cards in the stack of cards 114 resting on the card support 124 into randomly selected card storage positions within the wheel 171 of the card storage device 170.

Figure 9B:
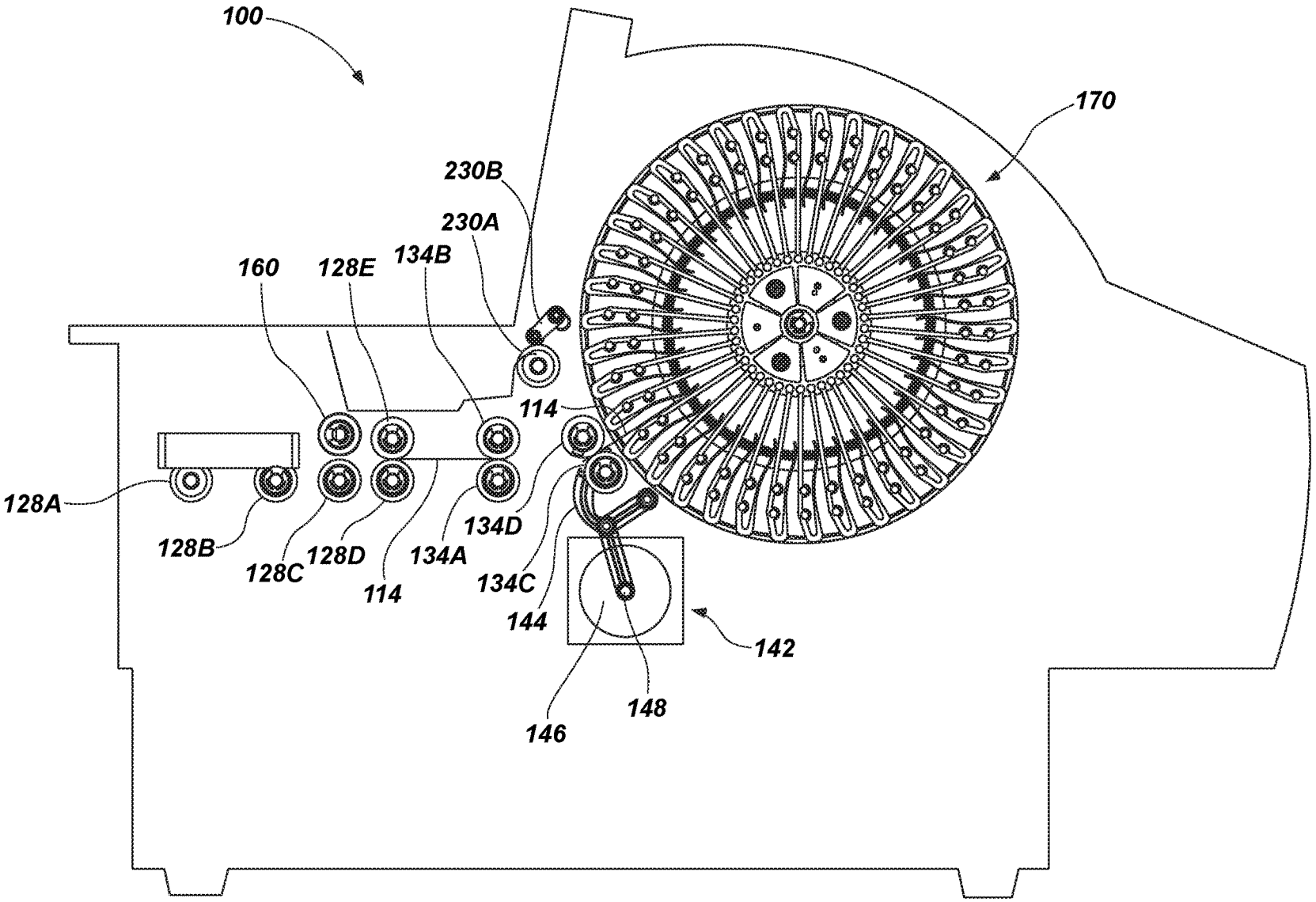

The control system 280 may selectively control movement of the various components of the card input mechanism 120 and the card storage device 170 to cause the cards in the stack of cards 114 to be inserted into the wheel 171 and positioned in their randomly assigned card storage compartments 172. To accomplish insertion of the cards into the wheel 171, the card shuffler 100 may actuate rotation of the pick-off rollers 128A-128E, as indicated at action 406 in FIG. 10. As indicated in action 408 of FIG. 10, the control system 280 causes the moving card 114 to be moved to the position at which the card image sensor (e.g., a camera) 252 may acquire one or more images of the card 114. FIG. 9B illustrates a first card 114 being driven from the bottommost position in the stack of cards 114 on the card support 124 by the pick-off rollers 128A-128E to the position at which the card image sensor 252 (FIG. 5) may acquire an image of the card 114. As each card 114 moves from the pick-off rollers 128A-128E toward the speed-up rollers 134A-134D, movement of the leading edge of each card 114 over the camera trigger sensor 316 (FIG. 8) will be detected by the camera trigger sensor 316. The control system 280, upon detection of the signal generated by the camera trigger sensor 316, may cause the card imaging system 250 (FIG. 5) to acquire one or more images of the card 114 using the card image sensor 252. The card imaging system 250 may use the acquired images to identify the card 114 (e.g., the rank and suit of a standard playing card).

The acquired card images may not be employed during normal operation of the card shuffler 100 in a shuffling mode during game play. The acquired card images may be used, however, to verify the cards in a playing card hand (e.g., a winning hand) by recalling the images from memory device 290 of the control system 280 of the card shuffler 100 after a round of game play, and may be used in a sorting operational mode or a card verification operational mode of the card shuffler 100. Optionally, upon moving all cards 114 into the card storage device 170, the control system 280 may compare the actual identity of each card in the set of cards in the wheel 171 (determined using the card imaging system 250) to identities of an expected set of cards, so as to verify that cards that should not be present in the set are not included (e.g., duplicate cards of any particular rank and suit), and that cards that should be present are not absent. Thus, the accuracy and completeness of a set of cards being shuffled by the card shuffler 100 (e.g., a single deck of standard playing cards) may be automatically verified by the control system 280 of the card shuffler 100 with each shuffling operation performed by the card shuffler 100. The card shuffler 100 may be configured to dispense cards from the wheel 171 only if the verification process determines the accuracy and completeness of the set of cards. In the event the verification process determines that the set of cards is incomplete or otherwise inaccurate, the card shuffler 100 may be configured not to dispense the shuffled cards and to display an error message or other signal to a user using the data output device 296 of the control system 280.

After acquiring one or more images of the card 114, the card 114 may be moved into the wheel 171 using the speed-up rollers 134A-134D and the card packer 144 of the card packing device 142, as indicated at action 412 of FIG. 10. In action 410 of FIG. 10, the control system 280 selectively rotates the wheel 171 to a proper position relative to the speed-up rollers 134A-134D (which are disposed at a fixed, static location within the card shuffler 100) for insertion of each card into the assigned card storage compartment 172 for the playing card 114, respectively, and steps down the card weight device 150. The control system 280 then may cause the card packer 144 of the packing device 142 (as needed) to rotate until it returns to its original position, as indicated at action 414 of FIG. 10. The control system 280 then may stop the pick-off rollers 128A-128E as indicated at action 415, and then actuate rotation of the pick-off rollers 128A-128E to cause the card 114 to be gripped by the rotating speed-up rollers 134A-134D, which will move the card 114 to the card in/out sensor 332 and into the wheel 171, as indicated at actions 416 and 418, respectively, in FIG. 10. As shown in FIG. 9B, the control system 280 then may actuate the card packer 144 of the card packing device 142 using the packer motor 146, as indicated at action 420 in FIG. 10, which ensures that the card 114 is fully inserted within the corresponding card storage compartment 172 in the wheel 171, as previously discussed.

Figure 9C:
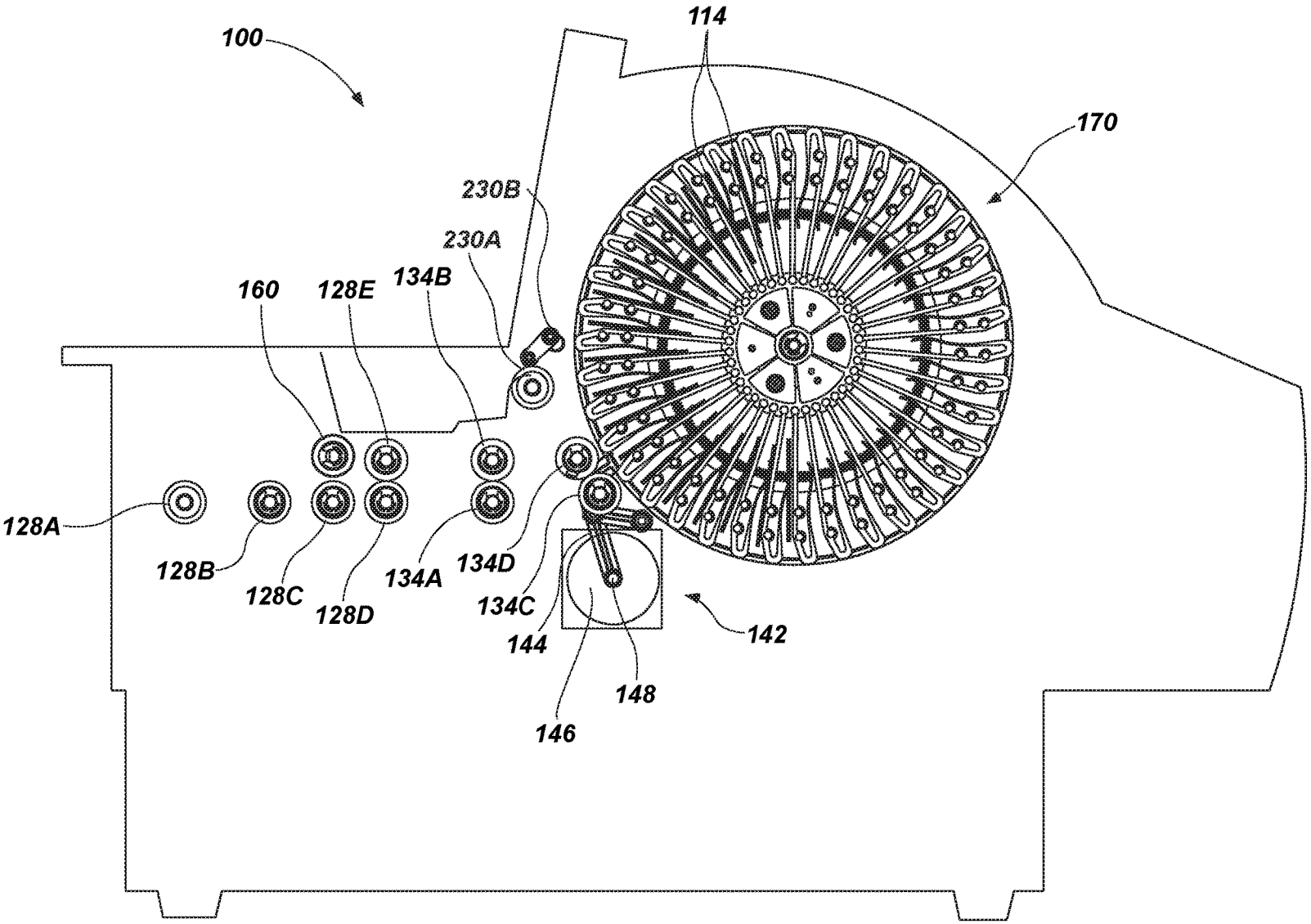

The control system 280 then determines in action 422 whether or not the number of cards that have been inserted into the wheel 171 is equal to the expected number of cards 114 to be in the initial stack of cards 114 on the card support 124. If not, the control system 280 determines in action 424 whether additional cards 114 are present in the card input area 106. If not, an error message is displayed in action 426, because less than the expected number of cards 114 have been inserted and there are no more cards 114 for insertion in the card input area 106. If yes, the control system 280 repeats actions 406 through 420 until all cards 114 have been inserted into the wheel 171, as shown in FIG. 9C. In action 422, if the number of cards 114 that have been inserted into the wheel 171 is equal to the expected number of cards in the initial stack of cards 114 on the card support 124, the control system 280 then determines whether any cards 114 unexpectedly remain present on the card support 124 using the feeder card present sensor 310 as indicated at action 425. If so, the card shuffler 100 ceases operation and an error message may be displayed on the data output device 296 (FIG. 8), as indicated in action 426 in FIG. 10. If not, the control system 280 has completed the shuffling and hand forming operational phase, and moves to a playing card hand dealing phase and waits for a user (e.g., a dealer) to push a start button or otherwise input information into the card shuffler 100 using the data input device 294 (FIG. 8), as shown in action 428 of FIG. 10, indicating that the user is ready for the card shuffler 100 to dispense the first playing card hand. The control system 280 then causes the card shuffler 100 to deal a playing card hand by ejecting cards out from one of the card storage compartments 172 of the wheel 171 and into the card output area 108 using the card output mechanism 220, as indicated at action 430 in FIG. 10.

Figure 9D:
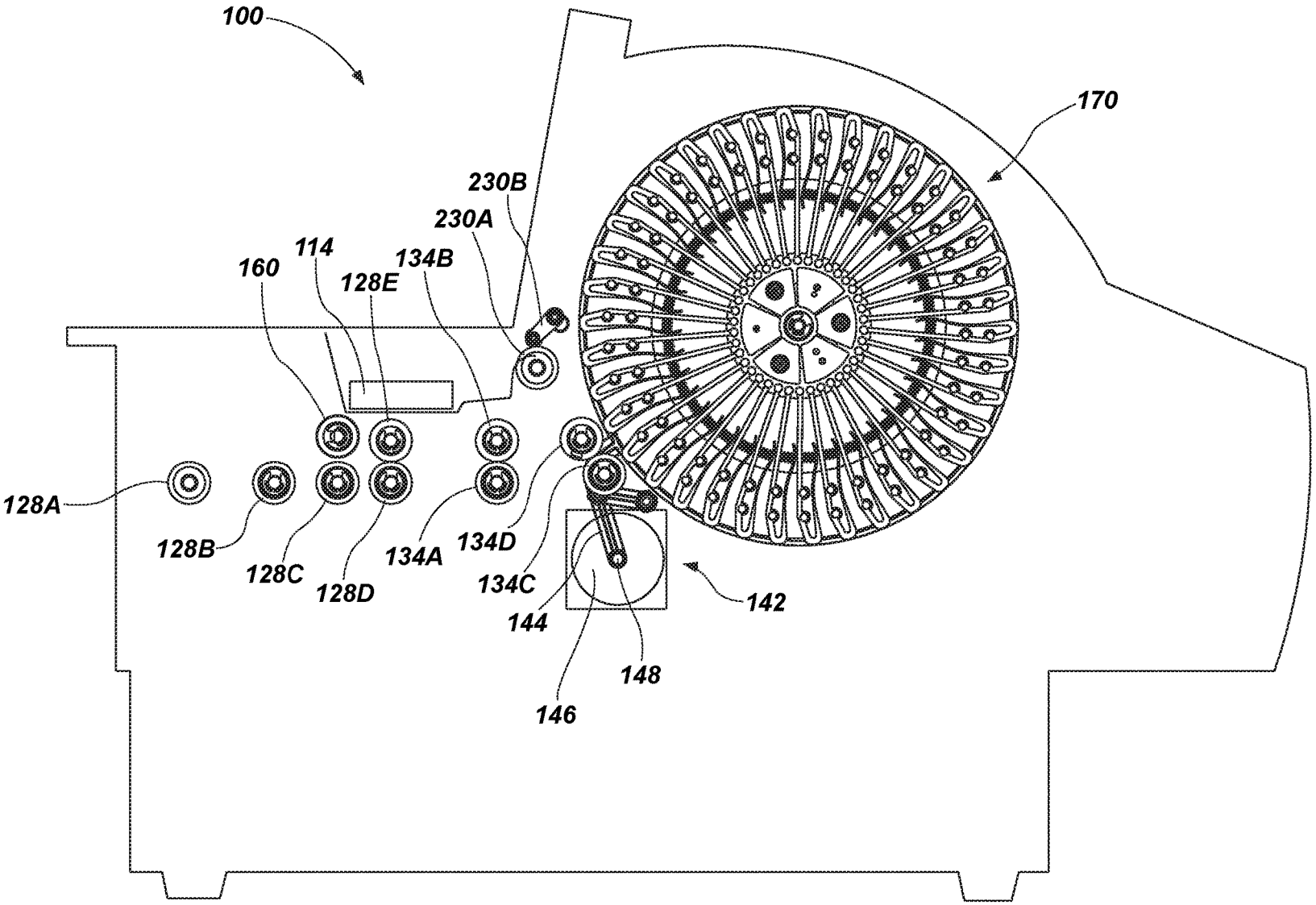

In dealing a hand in accordance with action 430 of FIG. 10, the control system 280 rotates the wheel 171 to the rotational position at which the card storage compartment 172 from which a playing card hand is to be dispensed into the card output area 108 is aligned with the ejector levers of the ejector arms 222 and the card output rollers 230. The control system 280 then actuates rotation of the card output rollers 230, and causes the ejector arms 222 to move from the retracted position to the extended position. As the ejector arms 222 are moved from the retracted position to the extended position, the playing cards 114 in the card storage compartment 172 with which the ejector levers of the ejector arms 222 are aligned are pushed out from the respective card storage compartment 172 and into the speed-up rollers 134A-134D, which then drive movement of the cards 114 (which may comprise a playing card hand for use in a round of game play) into the card output area 108. The cards 114 in each card storage compartment 172 are simultaneously ejected out from the wheel 171 together as a group and into the card output area 108. FIG. 9D illustrates a group of cards 114, which may comprise a playing card hand, resting in the card output area 108 and awaiting removal from the card output area 108 by the user (e.g., a dealer).

The control system 280 may detect when a user removes the group of randomized cards 114 from the card output area 108 using the platform card present sensor 328, as indicated in action 434 of FIG. 10. As indicated in action 436 of FIG. 10, once the group of cards 114 is removed from the card output area 108, the control system 280 determines whether additional playing card hands remain in card storage compartments 172 in the wheel 171. If yes, the control system 280 repeats actions 430 through 434. If not, the remaining cards held in card storage compartments 172 of the wheel 171, which are not cards used to form playing card hands or used in the round of game play, are unloaded from the wheel 171 and are combined into the card output area 108, as indicated at action 438 of FIG. 10. Once the wheel 171 has been completely unloaded, the control system 280 stops operation, as indicated in action 440, and awaits commencement of a new round of game play by a user again loading a deck of cards into the card input area in accordance with action 400. In other embodiments, cards from two or more compartments are unloaded into the output area 108 and are combined. For example, a security card may be positioned in a first compartment. The sensing system may sense the card is a security card and the processor causes the card to be stored in a designated security card compartment. In one embodiment, only one security card is stored in a designated security card compartment. The security card may be unloaded prior to unloading the first group of cards into the card output area. The first set of cards, typically the dealer hand is delivered on top of the security card, and when that hand is lifted out of the card output area, the identity of the bottom card is concealed. In further embodiments, a security card may be transferred to a storage compartment 172, and a group of cards comprising a dealer hand may then be transferred into the same storage compartment 172 holding the security card and placed over the security card. The dealer hand with security card on the bottom may then be unloaded into the card output area.

In some embodiments, the control system 280 may be configured under control of the program to unload the playing card hands sequentially from neighboring adjacent card storage compartments 172. For example, the card storage compartment "1" may be unloaded first, then card storage compartment "2," then card storage compartment "3," etc. In other embodiments, however, the control system 280 may be configured under control of the program to unload the playing card hands from the card storage compartments 172 holding playing card hands in a randomly selected sequence. For example, the card storage compartment "8" may be unloaded first, then card storage compartment "2," then card storage compartment "6," etc.

As shown in FIG. 10, if at any time after the first hand or another group of cards is delivered by the card shuffler 100 in accordance with action 430, a user (e.g., a dealer) may push a button or otherwise indicate to the shuffler 100 using the data input device 294 that all hands needed for the playing card game have been dealt (or that the round of the playing card game should be ended for any other reason), and the control system 280 then may proceed to empty the card storage device 170 in accordance with action 438 and stop the round of game play in accordance with action 440. For example, if the control system 280 is programmed to generate six (6) playing card hands in each round of game play, but only three players are playing the game, the user may push a button or otherwise indicate to the shuffler 100 using the data input device 294 that the round of game play should be ended after the third playing card hand has been dispensed to the card output area 108, as indicated at action 432 of FIG. 10.

In some embodiments, the control system 280 may be configured to control operation of the automatic card shuffler 100 in a first operational mode during use of the automatic card shuffler 100 in a playing card game with at least a predefined number of players (e.g., four (4) or more players), and to control operation of the automatic card shuffler 100 in a second operational mode during use of the automatic card shuffler 100 in the playing card game with less than the predefined number of players (e.g., three (3) or less players). The shuffling process may be performed more rapidly when less playing card hands need to be formed in separate card storage compartments 172 of the wheel 171. In other words, a time required to input a number of playing cards into the card storage compartment 172 in the second operational mode may be less than a time required to input the same number of playing cards into the card storage compartment 172 in the first operational mode. Thus, the second operational mode may be characterized as a "quick" mode. Thus, when the control system 280 is in the first operational mode, the control system 280 may be configured under control of a program to cause the automatic card shuffler 100 to form playing card hands in a first number (e.g., four (4) or more) of designated adjacent card storage compartments 172 in the wheel 171. When the control system 280 is in the second operational mode (i.e., the quick mode), the control system 280 may be configured under control of the program to form playing card hands only in a second number (e.g., three (3) or less) of designated adjacent card storage compartments 172 in the wheel 171 and not in any other card storage compartments 172. In some embodiments, the user may be able to input the number of players playing the playing card game into the control system 280, and the card shuffler 100 then may only form the required number of playing card hands in a corresponding number of card storage compartments 172.

As previously mentioned, the card shuffler 100 also may be used to sort cards in a stack of cards placed on the card support 124 in the card input area 106 into a predefined order, such as a sequential "new deck" order for a standard deck of playing cards. The card shuffler 100 may be placed in a sort mode of operation (and/or a shuffle mode of operation) using the data input device 294 of the control system 280 (FIG. 8). When the card shuffler 100 is in the sort mode, after the feeder card present sensor 310 detects the presence of the stack of cards 114 on the card support 124 for a predetermined amount of time (e.g., three seconds), the control system 280 may automatically commence a sorting operation. The card input mechanism 120 and the card imaging system 250 may be used to sequentially identify the rank and suit of the cards in the stack (using the card imaging system 250), and to respectively move the cards into predetermined positions within the wheel 171 of the card storage device 170, such that the cards are ordered within the wheel 171 in a predetermined, selected order in a direction extending from one card storage compartment 172 in the wheel 171 sequentially through neighboring adjacent card storage compartments 172 in the wheel 171.

To sort cards into a desired order, the control system 280 of the card shuffler 100 may reference a Sort Table, which may be stored in a memory device 290 of the control system 280. The Sort Table correlates the identity of specific cards in a predefined set of cards (e.g., a deck of standard playing cards) to one of the fifty-four (54) card storage positions in the wheel 171 in the predefined order (e.g., new deck order). Each card storage compartment 172 in the wheel 171 may be designated with two (2) card storage positions. In some modes, only two cards are inserted into each compartment, and the second card inserted may be positioned above or below the first inserted card in order to achieve a predetermined sequence of cards. There is a limit of two cards per compartment for sorting into a predetermined order because the structure will not allow a third card to be inserted between the first two inserted cards without modification. When any card is inserted into a card storage compartment 172 in the wheel 171, there are two states that may exist. The first possible state is the state wherein no other card is present in the respective card storage compartment 172, and the second possible state is the state wherein one card is already present in the respective card storage compartment 172. The control system 280 may include a first wheel position for each compartment for a first state, and a second wheel position for the same compartment in a second state.

A wheel home sensor 324 and the encoder of the wheel motor 174 may be used in embodiments to determine a reference position of the wheel. Locations of the first and second wheel positions for each compartment may be stored in memory. In one embodiment of the disclosure, the second wheel position is a predetermined number of stepper steps above the first wheel position, for instance, 120 steps. The location of the home position of the wheel 171 may be periodically identified by the control system 280 in a calibration process.

In the sorting and/or verification mode of operation, the control system 280 may use two card positions (two card positions per card storage compartment 172), rather than only one card position during random card group formation.

Using the Card Position Table and the location information stored in memory, the control system 280 controls operation of the card input mechanism 120 and the card storage device 170 to sequentially position each card into the appropriate card storage compartment 172 (and appropriate upper or lower card storage position therein) so as to selectively order the cards in the wheel 171 in a predetermined order. As a particular card is inserted into the wheel 171, the control system 280 references the Card Position Table to determine in which of the seventy-six (76) card storage positions the card is to be positioned. The control system 280 determines whether there is already a card located in the respective card storage compartment 172 in which the card storage position is located. If there is not a card already present in the card storage compartment 172, the control system 280 selects a first card position stored in memory to determine where to position the wheel 171 such that, when the first card is inserted into an empty compartment of the wheel 171 by the speed-up rollers 134A-134D, the card will be inserted into the center of the card storage compartment 172.

If there is a card already present in the card storage compartment 172, the control system 280 will continue to insert cards beneath the first card when the shuffler is in the shuffling mode. When the shuffler is in the sorting mode, or in a shuffled deck forming mode and there is already at least one card in the compartment, the processor will cause the next card to be loaded either on top of the card or cards already in the compartment, or beneath the cards already in the compartment, by selecting a first or second storage location stored in memory.

Thus, after selectively inserting the second card into any given card storage compartment 172 above or below the first card inserted into the card storage compartment 172, the two cards in the card storage compartment 172 will be appropriately positioned in the upper card storage position and the lower card storage position, respectively, in that card storage compartment 172, depending upon the mode of operation selected. For example, the shuffler may be configured to deliver randomly formed hands of cards or partial hands in a first mode, may be configured to combine and form a deck of a predetermined order in the output tray, or may be configured to combine and form a randomly ordered deck of cards in the output tray.

After placing the cards in the wheel 171 such that the cards are in the predetermined, selected order within the wheel 171, the cards may be ejected out from the wheel 171 from sequential card storage compartments 172, as previously discussed, to place the stack of sorted cards into the card output area 108 in the predetermined order. The control system 280 then may detect when a user has removed the stack of sorted cards from the card output area 108, at which time the control system 280 may await insertion of an additional stack of cards into the card input area 106 or other data input provided by the user using the data input device 294.

In embodiments of the disclosure, the automatic card shuffler 00 is configured to sort special decks of cards into an original pack order, to randomize special decks, for example when the total card count differs from the usual 52-54 cards. For example, the shuffler 100 may be used to shuffle a Canasta deck, or other decks with cards of a certain rank removed, or when additional cards are added. Non-limiting examples of additional cards include extra suits, bonus indicator cards for a mystery prize, promotional cards offering free goods and services, or giving the player other comps and player rewards, security cards such as a cut card and the like. The card sensing system in these embodiments is adapted to read the special cards such that the position of the special cards in the wheel and eventually in the groups of cards being delivered into play is known by the system.

Referring again to FIG. 8, in some embodiments, the card shuffler 100 may further include a modem 306 operatively coupled with the control system 280. The modem 306 may be used to transmit information to, and receive information from, a remote server. In some embodiments, the modem 306 may comprise a wireless modem, such as a cellular modem configured for operation in the ultra-high frequency range (UHF) (e.g., about 800 MHz to about 3,000 MHz). The modem 306 may be configured to modulate and demodulate data between digital and analog signals in some embodiments. In other embodiments, the shuffler 100 is connected to the network by a hardwire connection.

In some embodiments, the control system 280 may be configured to store information in the memory device 290, such as historical game play information, current operational status or mode of the card shuffler 100, playing card hand compositions, error logs, etc. Such information may be transmitted to a remote server by the modem 306 so as to allow remote, system level monitoring of the card shuffler 100 and/or playing card games being played using the card shuffler 100. For example, upon randomly dealing a winning hand of predefined composition, information may be wirelessly (or by hard wired connection) transmitted from the automatic card shuffler 100 to a remote server using the modem 306 to indicate that the winning hand has been dealt by the card shuffler 100 to the remote server. The information transmitted may also identify the composition of the winning hand, so as to allow verification of the winning hand.

In additional embodiments, the card shuffler 100 may receive information from a remote server via the modem 306 (or by hard wired connection), and the received information may be used to update or verify operational software in the memory device 290 of the control system 280. For example, in some embodiments, the modem 306 may be used to receive information including a software verification algorithm from a remote server. The control system 280 may execute the software verification algorithm, and transmit information including data acquired upon execution of the software verification algorithm to the remote server using the modem 306. The information transmitted to the remote server may be used to identity operational software installed in the memory device 290 of the control system 280, so as to allow verification that the operational software installed is the intended operational software.

As previously discussed herein, embodiments of the automatic card shuffler 100 disclosed herein may be used in conjunction with specialized playing card games in which playing card hands are formed and dealt to players playing the specialized playing card games. In many such games, a dealer is a participant in the playing card games. Players are incentivized to illicitly identify cards in the dealer's playing card hand prior to placing wagers so as to attain an unfair advantage in the playing card game. The automatic card shuffler 100 disclosed herein may be used in conjunction with a so-called "security card," which may be used by the dealer to obscure the identity of one or more cards in the dealers playing card hand as it is dispensed from the automatic card shuffler 100.

The security card may be any card that is not used as a card in a playing card hand of the playing card game. For example, cut cards that are used by dealers in playing card games, in which the cards are manually shuffled by the dealer, to allow players to randomly "cut" the deck to assist in randomizing the shuffling process. Such cut cards are not used in forming playing card hands in the playing card game, and may be used as a security card in accordance with methods as disclosed herein.

Referring again to FIG. 1, a stack of unshuffled playing cards may be placed into the card input area 106 of the automatic card shuffler 100. The stack of unshuffled playing cards may include at least one security card (i.e., a card not usable in the playing card game). The automatic card shuffler 100 may be used to generate randomized playing card hands in card storage compartments 172 within the card storage device 170 of the automatic card shuffler 100 as previously described herein. The automatic card shuffler 100 may be used to position the at least one security card beneath at least one randomized group of cards delivered to the card output area 108. As groups of cards, for example, when hands are dispensed, at least one card in the at least one randomized group of playing cards may be obscured using the at least one security card. The group of playing cards that includes the at least one card obscured by the security card may be the dealer's hand, and may be, for example, the first playing card hand dispensed by the card shuffler 100. In embodiments, the bottom card in the designated dealer's hand is the security card.

In some embodiments, the control system 280 may be configured to identify the security card as it is inserted into the card storage device 170 using the card imaging system 250. In such embodiments, the security card may be placed anywhere in the stack of unshuffled cards placed in the card input area 106, and the card shuffler 100 will identify the security card as it is inserted and place it in a designated security card compartment so that it can be dispensed immediately prior to dispensing the dealer's playing card hand into the card output area 108.

In other embodiments, the control system 280 may be configured to assume that either the top or bottom card in the stack of unshuffled cards placed in the card input area 106 will be the security card, and, accordingly, the dealer may consistently place the security card on either the top or bottom card in the stack of unshuffled cards placed in the card input area 106 after each round of game play. The control system 280 will then always place the security card (which will be either the top or bottom card in the stack of unshuffled cards in the card input area 106) in the designated security card compartment within the card storage device 170 so as to obscure the dealer's playing card hand. More than one security card may be used during card distribution. In that instance, multiple security card compartments, one per card is used to store the security cards. Security card compartments in forms of the invention may be adapted to hold only one card. In other embodiments, every compartment in the wheel is adapted to hold more than one card, and at least two cards.

As playing card hands are dispensed face-down into the card output area 108, the security card may be positioned at the bottom of the group of cards in the output area 108. In some embodiments, designated security card compartments are configured to accept only one security card each. This configuration saves space that can be reallocated to the other compartments that require multiple cards. The card storage device 170 may include one or multiple designated security.

In some embodiments, designated security card compartments are configured to accept only one security card each. This configuration saves space that can be reallocated to the other compartments that require multiple cards. The card storage device 170 may include one or multiple designated security.

Additional non-limiting example embodiments are disclosed below.

Embodiment 1

An automatic card shuffler, comprising: a card input mechanism for inputting cards into the automatic card shuffler; a card storage device for receiving cards from the card input mechanism and temporarily storing cards within the automatic card shuffler, the card storage device comprising a movable wheel configured to rotate within the automatic card shuffler, the movable wheel comprising a plurality of card storage compartments, at least a majority of the card storage compartment sized and configured to hold two or more cards therein; and a card output mechanism for outputting cards from the automatic card shuffler; wherein the card output mechanism is configured to eject cards out from the card storage compartments and into a card output compartment such that the cards are oriented at a downward angle of between about 2° and about 15° relative to a horizontal plane at all times as the cards move from each card storage compartment and into the card output compartment.

Embodiment 2

The automatic card shuffler of Embodiment 1, wherein the card output compartment is configured such that cards held therein are oriented at an angle of between about 2° and about 15° relative to the horizontal plane.

Embodiment 3

The automatic card shuffler of Embodiment 1 or Embodiment 2, wherein the card output mechanism is configured to eject cards out from the card storage compartments and into a card output compartment such that the cards are oriented at a downward angle of between about 2° and about 5° relative to a horizontal plane at all times as the cards move from each card storage compartment and into the card output tray.

Embodiment 4

The automatic card shuffler of any one of Embodiments 1 through 3, further comprising a card reading system configured to acquire data from one or more images of cards moving through the card input mechanism and toward the card storage device and to identify one or more distinguishing characteristics of the cards comprising at least one of rank and suit using the one or more images.

Embodiment 5

An automatic card shuffler, comprising: a card input mechanism for inputting cards into the automatic card shuffler; a card storage device for receiving cards from the card input mechanism and temporarily storing cards within the automatic card shuffler; and a card output mechanism for moving shuffled cards from the card storage device and outputting the shuffled cards from the card storage device; and a control system configured to control operation of the automatic card shuffler, the control system including: a touch screen control panel configured to receive input information from an operator of the automatic card shuffler and to output information to the operator of the automatic card shuffler; and a player display mounted to the automatic card shuffler, the control system configured to display information to players of a playing card game in which the automatic card shuffler is used on the player display.

Embodiment 6

The automatic card shuffler of Embodiment 5, wherein the control system is configured to display information to players of a playing card game in which the automatic card shuffler is used on the player display relating to at least one of minimum or maximum bet quantities, an indication of a winning hand, a recommended player card hand, game advice, game rules, a casino identity, and identification of a game being played in conjunction with the automatic card shuffler.

Embodiment 7

The automatic card shuffler of Embodiment 5 or Embodiment 6, wherein the touch screen control panel is oriented for viewing from a first side of the automatic card shuffler, and the player display is oriented for viewing from an opposing second side of the automatic card shuffler.

Embodiment 8

An automatic card shuffler, comprising: a card input receptacle; a card output receptacle; a card input mechanism for inputting cards into the automatic card shuffler from the card input receptacle; a card storage device for receiving cards from the card input mechanism and temporarily storing cards within the automatic card shuffler; a card output mechanism for moving shuffled cards from the card storage device to the card output receptacle; and a drip pan located and configured to divert fluid spilled into at least one of the card input receptacle and the card output receptacle to an exterior of the automatic card shuffler.

Embodiment 9

The automatic card shuffler of Embodiment 8, further comprising at least one outer cover including at least one aperture extending therethrough, the at least one aperture located and configured to allow spilled fluid diverted by the drip pan to pass out from the automatic card shuffler through the aperture in the at least one outer cover.

Embodiment 10

The automatic card shuffler of Embodiment 9, wherein the drip pan extends at least partially through the at least one aperture extending through the at least one outer cover.

Embodiment 11

The automatic card shuffler of any one of Embodiments 8 through 10, wherein the drip pan is located vertically below at least one of the card input receptacle and the card output receptacle.

Embodiment 12

The automatic card shuffler of any one of Embodiments 8 through 11, wherein the drip pan comprises a generally planar base member oriented generally horizontally within the automatic card shuffler, the drip plan including one or more lateral sidewalls extending vertically from the base member so as to laterally confine fluid spilled on the generally planar base member.

Embodiment 13

An automatic card shuffler, comprising: a card input area; a card output area; a card input mechanism for inputting cards into the automatic card shuffler from the card input area; a card storage device for receiving cards from the card input mechanism and temporarily storing cards within the automatic card shuffler; a card output mechanism for moving shuffled cards from the card storage device to the card output area; wherein the card input mechanism comprises: a plurality of rollers located and configured to drive movement of cards along a card input path extending from the card input area to toward to the card storage device; a motor configured to drive rotation of at least some rollers of the plurality of rollers; and at least one slide bar extending continuously between the rollers of the plurality of rollers along the input path, the slide bar having an upper surface recessed from apexes of the rollers of the plurality of rollers by an average distance of about 0.07 inches or less.

Embodiment 14

The automatic card shuffler of Embodiment 13, wherein the at least one slide bar is located and configured to reduce operational noise generated by cards moving along the input path responsive to operation of the card input mechanism.

Embodiment 15

The automatic card shuffler of Embodiment 13 or Embodiment 14, wherein the at least one slide bar comprises two slide bars oriented at least substantially parallel to one another.

Embodiment 16

An automatic card shuffler configured to generate a number of randomized playing card hands for use in a playing card game, comprising: a card input mechanism for inputting cards into the automatic card shuffler; a card storage device for receiving cards from the card input mechanism and temporarily storing cards within the automatic card shuffler, the card storage device comprising a plurality of card storage compartments, at least a majority of the card storage compartments sized and configured to hold two or more cards therein; and a card output mechanism for moving shuffled cards from the card storage device and outputting the shuffled cards into a card delivery tray; and a control system configured to control operation of the automatic card shuffler in a first operational mode during use of the automatic card shuffler in a playing card game with at least a predefined number of players, and to control operation of the automatic card shuffler in a second operational mode during use of the automatic card shuffler in the playing card game with less than the predefined number of players; wherein the control system is configured under control of a program to cause the automatic card shuffler to form playing card hands in a first number of designated adjacent card storage compartments of the plurality of card storage compartments in the first operational mode, and the control system is configured under control of the program to form playing card hands only in a second number of designated adjacent card storage compartments of the plurality of card storage compartments and not in any other card storage compartments of the plurality of card storage compartments in the second operational mode, the second number being lower than the first number.

Embodiment 17

The automatic card shuffler of Embodiment 16, wherein the second number is equal to one less than the predefined number of players.

Embodiment 18

The automatic card shuffler of Embodiment 16 or Embodiment 17, wherein the predefined number of players is four (4).

Embodiment 19

The automatic card shuffler of any one of Embodiments 16 through 18, wherein the control system is configured under control of a program to cause the automatic card shuffler to form a first number of playing card hands in respective designated adjacent card storage compartments of the plurality of card storage compartments in the first operational mode, and the control system is configured under control of the program to form a second number of playing card hands in respective designated adjacent card storage compartments of the plurality of card storage compartments in the second operational mode, the second number of playing card hands being less than the first number of playing card hands.

Embodiment 20

The automatic card shuffler of any one of Embodiments 16 through 19, wherein a time required to input a number of playing cards into the card storage device in the second operational mode is less than a time required to input the same number of playing cards into the card storage device in the first operational mode.

Embodiment 21

An automatic card shuffler configured to generate a number of randomized playing card hands for use in a playing card game, comprising: a card input mechanism for inputting cards into the automatic card shuffler; a card storage device for receiving cards from the card input mechanism and temporarily storing cards within the automatic card shuffler, the card storage device comprising a plurality of card storage compartments, at least a majority of the card storage compartments sized and configured to hold two or more cards therein; a card output mechanism for moving shuffled cards from the card storage device and outputting the shuffled cards into a card delivery tray; and a control system configured to control operation of the automatic card shuffler; a printer operationally coupled with the control system, the control system configured under control of a program to cause the printer to print information onto a printable medium using the printer, the information usable in verifying a winning playing card hand generated by the automatic card shuffler in a round of game play.

Embodiment 22

The automatic card shuffler of Embodiment 21, wherein the printable medium comprises paper.

Embodiment 23

The automatic card shuffler of Embodiment 21 or Embodiment 22, wherein the control system is configured under control of the program to print information onto the printable medium using the printer including identifies of all cards in a winning playing card hand generated by the automatic card shuffler in a round of game play.

Embodiment 24

An automatic card shuffler configured to generate a number of randomized playing card hands for use in a playing card game, comprising: a card input mechanism for inputting cards into the automatic card shuffler; a card storage device for receiving cards from the card input mechanism; a card output mechanism for moving shuffled cards from the card storage device and outputting the shuffled cards into a card delivery tray; and at least one light-generating device located within the automatic card shuffler and configured to generate light within the automatic card shuffler, the light not used by any sensor of the automatic card shuffler.

Embodiment 25

The automatic card shuffler of Embodiment 24, wherein the at least one light-generating device is located and configured to interfere with any imaging device located within the automatic card shuffler and not by the automatic card shuffler for operation thereof.

Embodiment 26

The automatic card shuffler of Embodiment 24 or Embodiment 25, wherein the at least one light-generating device comprises a strobe light configured to intermittently generate flashes of light.

Embodiment 27

A method of using an automatic card shuffler configured to generate a number of randomized playing card hands for use in a playing card game, the method comprising: using the automatic card shuffler to generate randomized playing card hands; dispensing the playing card hands from the automatic card shuffler and using the playing card hands in a playing card game; storing information relating to the playing card hands or the playing card game in a memory device of a control system of the automatic card shuffler; and upon randomly dealing a winning hand of predefined composition, transmitting the information from the automatic card shuffler to a remote server in response to a signal generated by the control system to indicate that the winning hand has been dealt to the remote server.

Embodiment 28

A method of using an automatic card shuffler configured to generate a number of randomized playing card hands for use in a playing card game, the method comprising: using the automatic card shuffler to generate randomized playing card hands; dispensing the playing card hands from the automatic card shuffler and using the playing card hands in a playing card game; storing information relating to at least one of the playing card hands and the playing card game in a memory device of a control system of the automatic card shuffler; and using a modem operatively coupled with the control system of the automatic card shuffler to receive information from a remote server and transmit information to the remote server, the sent and received information comprising a software verification algorithm used to verify an identity of software installed in the memory device of the control system.

Embodiment 29

The method of Embodiment 28, wherein using a modem comprises using a cellular modem.

Embodiment 30

A method of using an automatic card shuffler configured to generate a number of randomized playing card hands for use in a playing card game, the method comprising: placing a stack of unshuffled playing cards into a card input area of the automatic card shuffler, the stack of unshuffled playing cards including at least one security card not usable in the playing card game; using the automatic card shuffler to generate randomized playing card hands in card storage compartments within a card storage device of the automatic card shuffler; using the automatic card shuffler to position at least one dispensed randomized group of cards and the at least one security card at the bottom of the at least one dispensed randomized group in the card output area of the automatic card shuffler; and obscuring a bottom card in the group of using the at least one security card.

The example embodiments of the disclosure described above do not limit the scope of the invention, since these embodiments are merely examples of embodiments of the invention, which is defined by the scope of the appended claims and their legal equivalents. Any equivalent embodiments are within the scope of this invention. Indeed, various modifications of the disclosure, in addition to those shown and described herein, such as alternate useful combinations of the elements described, will become apparent to those skilled in the art from the description. Such modifications and embodiments also fall within the scope of the appended claims, including legal equivalents.

What is claimed is:

1. A method of using an automatic card shuffler, comprising:

causing, utilizing a card input mechanism, playing cards to be moved from a card input area to a temporary card storage;

forming a first number of playing card hands in a corresponding first number of designated card storage compartments of the temporary card storage when a control system of the automatic card shuffler is in a first operational mode; and forming a second, different number of playing card hands in a corresponding second number of designated card storage compartments of the temporary card storage when the control system is in a second operational mode, the card storage compartments of the second number of designated card storage compartments being distinct from the card storage compartments of the first number of designated card storage compartments.

2. The method of claim 1, wherein forming the second number of playing card hands in the second number of designated card storage compartments of the temporary card storage when the control system is in the second operational mode comprises refraining from forming playing card hands in any other card storage compartments of the temporary card storage.

3. The method of claim 1, further comprising:

placing the control system in the first operational mode when a number of playing card hands to be formed is greater than or equal to a predefined threshold; and placing the control system in the second operational mode when the number of playing card hands to be formed is less than the predefined threshold.

4. The method of claim 1, further comprising:

causing, utilizing a card output mechanism, the first number of playing card hands to be moved from the corresponding first number of designated card storage compartments of the temporary card storage to a card delivery tray when the control system is in the first operational mode; and causing, utilizing the card output mechanism, the second number of playing card hands to be moved from the corresponding second number of designated card storage compartments of the temporary card storage to the card delivery tray when the control system is in the second operational mode.

5. The method of claim 4, further comprising maintaining an orientation of each playing card in the first number of playing card hands and the second number of playing card hands at a downward angle of between about 2° and about 15° relative to a horizontal plane at all times as each playing card moves from the temporary card storage into the card delivery tray.

6. The method of claim 1, further comprising:

forming the first number of playing card hands in the corresponding first number of designated card storage compartments of the temporary card storage over a first period of time when the control system is in the first operational mode; and forming the second, different number of playing card hands in the corresponding second number of designated card storage compartments of the temporary card storage over a second, shorter period of time when the control system is in the second operational mode.

7. The method of claim 1, further comprising:

causing, utilizing the card input mechanism, the playing cards to be moved from the card input area to the temporary card storage over a first period of time when the control system is in the first operational mode; and causing, utilizing the card input mechanism, the playing cards to be moved from the card input area to the temporary card storage over a second, shorter period of time when the control system is in the second operational mode.

8. The method of claim 1, further comprising accepting at the control system a user-input number of playing card hands to be formed, entering the first operational mode or the second operational mode, and forming the first number of playing card hands or the second number of playing card hands in an amount equal to the user-input number of playing card hands accepted at the control system.

9. A method of using a card shuffler, comprising:

inputting playing cards into the card shuffler utilizing a card input mechanism;

placing the playing cards into a temporary card storage within the card shuffler;

outputting at least one playing card from the temporary card storage into an output compartment utilizing a card output mechanism; and maintaining an orientation of the at least one playing card at a downward angle of between about 2° and about 15° relative to a horizontal plane at all times as the at least one playing card moves from the temporary card storage into the output compartment.

10. The method of claim 9, further comprising maintaining the orientation of the at least one playing card at the downward angle of between about 2° and about 15° relative to the horizontal plane when the at least one playing card is in the output compartment.

11. The method of claim 9, further comprising maintaining the orientation of the at least one playing card at a downward angle of between about 2° and about 5° relative to the horizontal plane at all times as the at least one playing card moves from the temporary card storage into the output compartment.

12. The method of claim 9, further comprising:

forming a first number of playing card hands in a corresponding first number of designated card storage compartments of the temporary card storage when a control system of the card shuffler is in a first operational mode; and forming a second, different number of playing card hands in a corresponding second number of designated card storage compartments of the temporary card storage when the control system is in a second operational mode, the card storage compartments of the second number of designated card storage compartments being distinct from the card storage compartments of the first number of designated card storage compartments.

13. A method of operating an automatic card shuffler, comprising:

causing, utilizing a card input mechanism, playing cards to be moved from a card input area to a temporary card storage;

forming, in response to placing a control system of the automatic card shuffler in a first operational mode, a first number of playing card hands in a corresponding first number of designated card storage compartments of the temporary card storage responsive to placing the control system in the first operational mode; and forming, in response to placing the control system of the automatic card shuffler in a second operational mode, a second, different number of playing card hands in a corresponding second number of designated card storage compartments of the temporary card storage responsive to placing the control system in the second operational mode, the card storage compartments of the second number of designated card storage compartments being distinct from the card storage compartments of the first number of designated card storage compartments.

14. The method of claim 13, wherein the forming the second number of playing card hands in the second number of designated card storage compartments of the temporary card storage responsive to placing the control system in the second operational mode comprises refraining from forming playing card hands in any other card storage compartments of the temporary card storage.

15. The method of claim 13, further comprising:

placing the control system in the first operational mode when a number of playing card hands to be formed is greater than or equal to a predefined threshold; and placing the control system in the second operational mode when the number of playing card hands to be formed is less than the predefined threshold.

16. The method of claim 15, further comprising:

placing the control system in the first operational mode when a number of playing card hands to be formed is greater than or equal to four; and placing the control system in the second operational mode when the number of playing card hands to be formed is less than four.

17. The method of claim 13, further comprising maintaining an orientation of each playing card in the first number of playing card hands and the second number of playing card hands at a downward angle of between about 2° and about 15° relative to a horizontal plane at all times while moving each playing card from the temporary card storage into a card delivery tray.

18. The method of claim 13, further comprising:

forming the first number of playing card hands in the corresponding first number of designated card storage compartments of the temporary card storage over a first period of time responsive to placing the control system in the first operational mode; and forming the second, different number of playing card hands in the corresponding second number of designated card storage compartments of the temporary card storage over a second, shorter period of time responsive to placing the control system in the second operational mode.

19. The method of claim 13, wherein placing the control system in the first operational mode or the second operational mode comprises accepting at the control system a user-input number of playing card hands to be formed, entering the first operational mode or the second operational mode responsive to accepting the user-input number of playing card hands to be formed, and forming the first number of playing card hands or the second number of playing card hands in an amount equal to the user-input number of playing card hands accepted at the control system.

20. The method of claim 13, wherein the forming the first number of playing card hands in the corresponding first number of designated card storage compartments of the temporary card storage responsive to placing the control system in the first operational mode comprises forming the first number of playing card hands in a corresponding first number of designated, mutually adjacent card storage compartments of the temporary card storage responsive to placing the control system in the first operational mode and wherein the forming the second number of playing card hands in the corresponding second number of designated card storage compartments of the temporary card storage responsive to placing the control system in the second operational mode comprises forming the second number of playing card hands in a corresponding second number of designated, mutually adjacent card storage compartments of the temporary card storage responsive to placing the control system in the second operational mode.

* * * * *